US010304433B2

(12) United States Patent
Kuno

(10) Patent No.: US 10,304,433 B2
(45) Date of Patent: May 28, 2019

(54) REACTION FORCE GENERATOR AND ELECTRONIC KEYBOARD INSTRUMENT

(71) Applicant: CASIO COMPUTER CO., LTD., Tokyo (JP)

(72) Inventor: Toshiya Kuno, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/049,223

(22) Filed: Jul. 30, 2018

(65) Prior Publication Data

US 2019/0043462 A1 Feb. 7, 2019

(30) Foreign Application Priority Data

Aug. 1, 2017 (JP) ..... 2017-148774

(51) Int. Cl.
*G10H 1/34* (2006.01)
*G10H 1/00* (2006.01)

(52) U.S. Cl.
CPC ..... *G10H 1/346* (2013.01); *G10H 1/0008* (2013.01); *G10H 2220/221* (2013.01); *G10H 2220/275* (2013.01)

(58) Field of Classification Search
CPC ..... G10H 1/346; G10H 1/0008
USPC ..... 84/744, 644, 719
See application file for complete search history.

(56) References Cited

U.S. PATENT DOCUMENTS 5,062,342 A * 11/1991 Nagatsuma ..... G10H 1/346 84/439
7,256,359 B2 * 8/2007 Nishida ..... G10H 1/346 200/1 B
8,324,488 B2 * 12/2012 Iwamoto ..... G10H 1/348 84/225
8,716,588 B2 * 5/2014 Yoshida ..... G10H 1/346 84/745
8,748,725 B2 * 6/2014 Iwase ..... G10H 1/346 84/433
9,040,807 B2 * 5/2015 Osuga ..... G10H 1/346 84/744

(Continued)

FOREIGN PATENT DOCUMENTS

JP 2010-262129 A 11/2010
JP 2015-102656 A 6/2015

(Continued)

*Primary Examiner* — David S Warren
(74) *Attorney, Agent, or Firm* — Chen Yoshimura LLP

(57) ABSTRACT

A reaction force generator includes a hollow elastic member made of an elastically deformable material and a protrusion protruding from an outer surface of the hollow elastic member, the protrusion being tiltable in at least a first direction and a second direction, the first and second direction being symmetric with each other about a neutral position of the protrusion, wherein at least one of physical dimensions and material properties of the hollow elastic member is asymmetric with respect to the neutral position of the protrusion along the first direction and the second direction such that a first reaction force that would be generated by the protrusion when tilted in the first direction and a second reaction force that would be generated by the protrusion when tilted in the second direction are asymmetric with respect to the neutral position of the protrusion.

20 Claims, 15 Drawing Sheets

(56) References Cited

U.S. PATENT DOCUMENTS

| | | | | |
|---|---|---|---|---|
| 9,269,336 | B2 * | 2/2016 | Osuga | G10H 1/346 |
| 9,424,825 | B2 * | 8/2016 | Osuga | G10H 1/34 |
| 9,489,006 | B2 * | 11/2016 | Harimoto | G05G 5/03 |
| 2007/0017354 | A1 * | 1/2007 | Nishida | G10H 1/346<br>84/724 |
| 2010/0282049 | A1 | 11/2010 | Yoshida | |
| 2011/0061518 | A1 * | 3/2011 | Iwamoto | G10H 1/348<br>84/746 |
| 2013/0319210 | A1 * | 12/2013 | Yoshida | G10H 1/34<br>84/745 |
| 2015/0090098 | A1 * | 4/2015 | Osuga | G10C 3/12<br>84/433 |
| 2015/0090103 | A1 * | 4/2015 | Osuga | G10H 1/346<br>84/744 |
| 2015/0090104 | A1 * | 4/2015 | Osuga | G10H 1/32<br>84/744 |
| 2018/0204554 | A1 * | 7/2018 | Harimoto | G10H 1/34 |
| 2019/0043462 | A1 * | 2/2019 | Kuno | G10H 1/346 |

FOREIGN PATENT DOCUMENTS

| | | | | | |
|---|---|---|---|---|---|
| JP | 2015-102658 | A | | 6/2015 | |
| JP | 2018180526 | A | * | 11/2018 | G10H 1/346 |

* cited by examiner

REACTION FORCE GENERATOR AND ELECTRONIC KEYBOARD INSTRUMENT

BACKGROUND OF THE INVENTION

Field of the Invention

The present invention relates to a reaction force generator and an electronic keyboard instrument.

Description of the Related Art

Reaction force generators which use an elastic member made of a rubber or the like are a widely known conventional technology.

In such reaction force generators, a dome-shaped hollow member is made of an elastic material, and a high-rigidity protrusion is formed on the outer surface of this hollow member, for example. When the protrusion is pressed in a direction which depresses the dome-shaped hollow member, at some point the outer wall of the hollow member buckles and thereby generates a large reaction force.

In this type of reaction force generator, the reaction force gradually increases until just before the outer wall of the hollow member buckles, and the reaction force then rapidly transitions from increasing to decreasing after the outer wall does buckle. The change in the reaction force at this time creates what is generally described as a "clicking" feeling.

This type of structure is typically used primarily in electronic switches for use in keyboards, where a conductive member such as carbon is attached to a protrusion formed inside the dome-shaped hollow member, for example. When the outer wall of the hollow member buckles, this conductive member comes into contact with a contact point on a circuit board or the like arranged beneath the hollow member, thereby conducting current. Here, this switching occurs at the moment at which the clicking feeling is felt in the fingertips, thereby allowing the user to intuitively recognize when the switching operation has been reliably completed.

Meanwhile, in acoustic keyboard instruments, pressing a key causes a hammer which operates in conjunction with the key to strike a string, thereby producing a sound. When a key is depressed gradually, the reaction force increases significantly at the position at which the hammer strikes the string and then decreases rapidly. This creates a characteristic clicking feeling (known as "let-off") which is transmitted to the fingers of the performer.

Similarly, in electronic keyboard instruments which electronically reproduce the sound of keyboard instruments, various techniques are employed to reproduce this characteristic clicking feeling (let-off) in order to allow the performer to perform while experiencing the feeling of playing an actual acoustic keyboard instrument. Incorporation of elastic-member based reaction force generators into electronic keyboard instruments has also been proposed for this purpose.

For example, Patent Document 1 discloses a configuration in which when a load begins to be applied to a dome-shaped elastic member made of an elastic material such as a rubber, the dome-shaped elastic member buckles suddenly when a prescribed load is reached, and the resulting change in reaction force reproduces the clicking feeling (let-off).

Patent Document 1: Japanese Patent Application Laid-Open Publication No. 2015-102656

SUMMARY OF THE INVENTION

Accordingly, the present invention is directed to a scheme that substantially obviates one or more of the problems due to limitations and disadvantages of the related art.

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides a reaction force generator that may include: a hollow elastic member made of an elastically deformable material and formed to be hollow; and a protrusion protruding from an outer surface of the hollow elastic member and having a free distal end that is tiltable in at least a first direction and a second direction due to elasticity of the hollow elastic member, the first and second directions being not in parallel with and is symmetric with respect to a virtual central line of the protrusion in a neutral position, the virtual central line being a straight line going from the free distal end of the protrusion towards a bottom of the protrusion on the hollow elastic member when the protrusion is not receiving any external force and is in the neutral position, wherein at least one of physical dimensions and material properties of the hollow elastic member is asymmetric with respect to the virtual central line along the first direction and the second direction such that a first reaction force that would be applied to an object by the protrusion when the object engages and tilts the protrusion in the first direction and a second reaction force that would be applied to the object by the protrusion when the object engages and tilts the protrusion in the second direction are asymmetric with respect to the virtual central line.

In the above-mentioned reaction force generator, the first direction may be opposite to the second direction.

In the above-mentioned reaction force generator, the first direction and the second direction may not be perpendicular to the prescribed direction.

In the above-mentioned reaction force generator, at least one of wall thickness, exterior shape, interior shape, type of material, and density of material of the hollow elastic member may be asymmetric with respect to the virtual central line.

In the above-mentioned reaction force generator, the hollow elastic member may be formed such that a relationship between a movement distance of the protrusion and the resulting reaction force is different over an entire stroke length of the protrusion between when the protrusion is tilted in the first direction and when the protrusion is tilted in the second direction.

In the above-mentioned reaction force generator, the hollow elastic member may be formed such that the first reaction force does not monotonically increase and has a peak as a movement distance of the protrusion tilted in the first direction increases.

In the above-mentioned reaction force generator, the hollow elastic member may be formed in a dome shape having a convexity in a neutral state, and the hollow elastic member may be formed such that when a movement distance of the protrusion tilted in the first direction reaches a prescribed threshold, a portion of the hollow elastic member on a side towards which the protrusion tilts flexes in a direction opposite to the convexity of the dome shape so as to form a concave portion.

In the above-mentioned reaction force generator, the hollow elastic member may be formed such that the second reaction force monotonically increases as a movement distance of the protrusion in the second direction increases.

In the above-mentioned reaction force generator, the hollow elastic member may be formed such that the second reaction force monotonically increases as a movement distance of the protrusion tilted in the second direction increases, and the hollow elastic member may be formed such that the second reaction force is smaller than the first reaction force.

In the above-mentioned reaction force generator, the free distal end of the protrusion may be further tiltable in a third direction that is not in parallel with the virtual central line and is different from the first and second directions, and the at least one of physical dimensions and material properties of the hollow elastic member may be asymmetric with respect to the virtual central line along the first, second, and third directions such that the first reaction force, the second reaction force, and a third reaction force that would be applied to the object by the protrusion when the object engages and tilts the protrusion in the third direction are asymmetric with respect to the virtual central line.

In another aspect, the present disclosure provides an electronic keyboard instrument that may include: the reaction force generator according to claim 1; a plurality of key action mechanisms, each of the key action mechanisms including; a key that undergoes a swinging motion when pressed and released; and a control element that moves in accordance with movement of the key, wherein in each of the plurality of key action mechanisms, the control element is arranged so as to press and tilt the protrusion in the first direction in response to a keypress operation and so as to press the protrusion in the second direction in response to a key release operation.

In the above-mentioned electronic keyboard instrument, a position and movement distance of the control element may be configured such that when pressing the protrusion in the first direction in response to the keypress operation, the control element clears the protrusion at a prescribed position, and also such that when pressing the protrusion in the second direction in response to a subsequent key release operation, the control element clears the protrusion at a prescribed position.

In another aspect, the present disclosure provides an electronic keyboard instrument that may include a plurality of key action mechanisms, each of the key action mechanisms including: a key that undergoes a swinging motion when pressed and released; a control element that moves in accordance with movement of the key; and a reaction force generator including: a hollow elastic member made of an elastically deformable material and formed in a hollow dome shape having a convexity in a neutral state; and a protrusion protruding from an outer surface of the hollow elastic member, the protrusion being tiltable due to elasticity of the hollow elastic member form a virtual central line that is defined as a straight line going from a free end of the protrusion towards the hollow elastic member when the protrusion is in a neutral position, wherein in each of the key action mechanisms, the control element and the reaction force generator are arranged such that when the key moves in response to a keypress operation, the control element moves in a first direction and engages and presses the protrusion in the first direction that is not in parallel to the virtual central line, thereby causing the protrusion to tilt in the first direction, and wherein in each of the key action mechanisms, the hollow elastic member is formed such that when a displacement of the control element reaches a prescribed amount during the keypress operation, a portion of the hollow elastic member on a side towards which the protrusion tilts flexes in a direction opposite to the convexity of the dome shape so as to form a concave portion.

In the above-mentioned electronic keyboard instrument, in each of the key action mechanisms, at least one of physical dimensions and material properties of the hollow elastic member may be asymmetric with respect to the virtual central line along the first direction and a second direction that is different from the first direction.

In the above-mentioned electronic keyboard instrument, in each of the key action mechanisms, the control element and the reaction force generator may be arranged such that when the key moves in response to a keyrelease operation, the control element moves in a second direction and engages and presses the protrusion in the second direction, thereby causing the protrusion to tilt in the second direction, the second direction being not in parallel to the virtual central line and being different from the first direction, and wherein in each of the key action mechanisms, at least one of physical dimensions and material properties of the hollow elastic member is asymmetric with respect to the virtual central line along the first direction and the second direction so that a relationship between a movement distance of the control element that engages and presses the protrusion and a resulting reaction force applied to the control element by the protrusion is different between when the control element moves in the first direction during the keypress operation and when control element moves in the second direction during the keyrelease operation.

In the above-mentioned electronic keyboard instrument, in each of the key action mechanisms, the hollow elastic member may be formed such that, as a movement distance of the control element in the first direction increases, a resulting reaction force applied to the control element by the protrusion does not monotonically increase and has a peak.

In the above-mentioned electronic keyboard instrument, in each of the key action mechanisms, the hollow elastic member may be formed such that, as a movement distance of the control element the first direction increases during the keypress operation, a resulting reaction force applied to the control element by the protrusion does not monotonically increase and has a peak and such that, as a movement distance of the control element in the second direction increases during the keyrelease operation, a resulting reaction force applied to the control element by the protrusion monotonically increases, and in each of the key action mechanisms, the hollow elastic member may be formed such that the reaction force is smaller than the reaction force in at least some of an entire stroke length of the key.

In the above-mentioned electronic keyboard instrument, in each of the key action mechanisms, the free distal end of the protrusion may be further tiltable in a third direction that is not in parallel with the virtual central line and is different from the first and second directions, and in each of the key action mechanisms, the at least one of physical dimensions and material properties of the hollow elastic member may be asymmetric with respect to the virtual central line along the first, second and third directions such that a relationship between a movement distance of the protrusion and a resulting reaction force generated by the protrusion is different among the first, second, and third directions of movement of the protrusion.

In the above-mentioned electronic keyboard instrument, in each of the key action mechanisms, a position and movement distance of the control element may be configured such that when pressing the protrusion in the first direction in response to the keypress operation, the control element clears the protrusion at a prescribed position, and also such that when pressing the protrusion in the second direction in response to a subsequent key release operation, the control element clears the protrusion at a prescribed position.

In the above-mentioned electronic keyboard instrument, in each of the key action mechanisms, the first direction may be opposite to the second direction.

It is to be understood that both the foregoing general description and the following detailed description are exemplary and explanatory, and are intended to provide further explanation of the invention as claimed.

DETAILED DESCRIPTION OF THE PREFERRED EMBODIMENTS

Figure 1A:
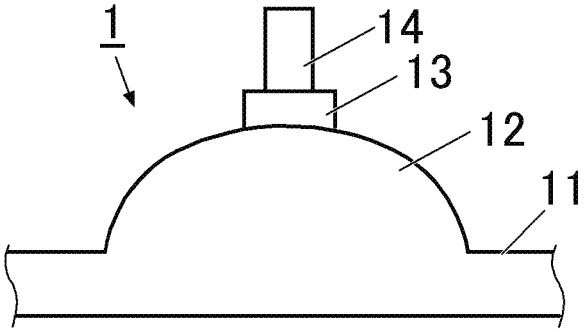
FIG. 1A is an elevational view of a reaction force generator according to an embodiment of the present invention.

One embodiment of a reaction force generator according to the present invention will be described with reference to FIGS. 1A to 6F.

Note that in the embodiments described below, various technically preferable limitations are introduced for purposes of implementing the present invention. However, the scope of the present invention is not limited to the embodiments described below nor to the examples illustrated in the drawings.

<Configuration of Reaction Force Generator>

Figure 1B:
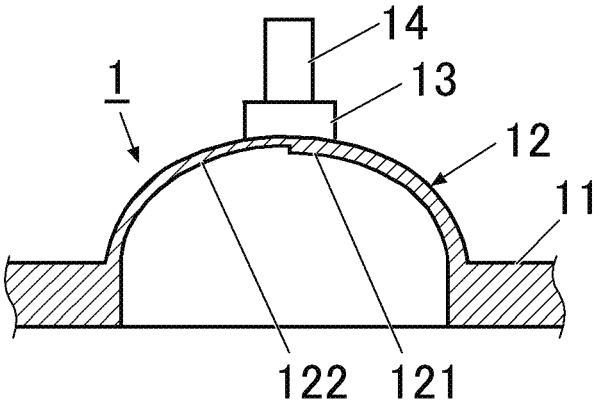
FIG. 1B is a cross-sectional view of the reaction force generator illustrated in FIG. 1A.

FIG. 1A is an elevational view illustrating the reaction force generator according to the present embodiment, and FIG. 1B is a cross-sectional side view of the reaction force generator illustrated in FIG. 1A.

As illustrated in FIGS. 1A and 1B, a reaction force generator 1 according to the present embodiment includes a hollow elastic member 12 formed to be hollow and a protrusion 14 protruding from the outer surface of the hollow elastic member 12.

In the present embodiment, the reaction force generator 1 further includes a base 11, and the hollow elastic member 12 is formed on top of this base 11 in an integrated manner therewith.

In the present embodiment, the hollow elastic member 12 is formed in a substantially hemispherical dome shape using an elastically deformable material such as a rubber or a synthetic resin, for example.

Note that although the material used to form the hollow elastic member 12 is not particularly limited and any elastic material can be used, it is preferable that the hollow elastic member 12 be made of a material with excellent durability which is capable of withstanding repeated use over extended periods of time.

Furthermore, the protrusion 14 is arranged on the substantially apical portion of the dome-shaped hollow elastic member 12 with a pedestal 13 interposed therebetween.

The protrusion 14 and the pedestal 13 are made of a synthetic resin or the like, for example.

It is preferable that the protrusion 14 and the pedestal 13 be relatively rigid in comparison to the hollow elastic member 12, and also it is preferable that these components be made of a rigid resin or have a solid structure.

Figure 2A:
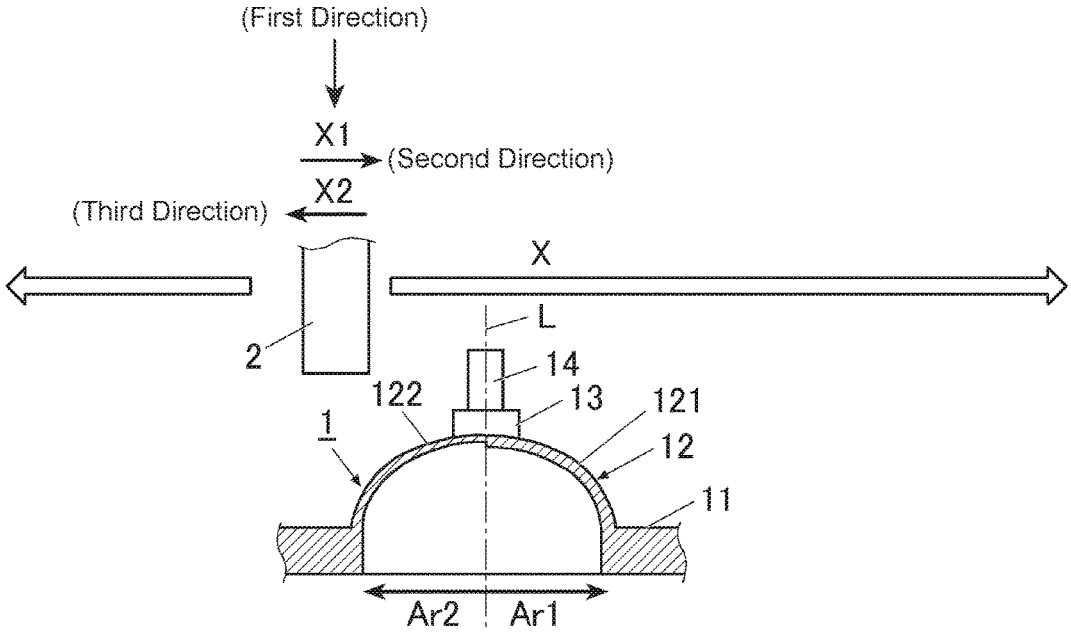
FIG. 2A is an explanatory drawing illustrating the relationship between the reaction force generator and a control element.

FIG. 2A is an explanatory drawing illustrating the relationship between the reaction force generator of the present embodiment and a control element which interacts with the protrusion.

As illustrated in FIG. 2A, in the present embodiment, letting an axial line L be set to the direction going from the free end (the upper end in the present embodiment as illustrated in FIG. 2A) of the protrusion 14 towards the hollow elastic member 12, a control element 2 interacts with the protrusion 14 from a direction different from a first direction parallel to this axial line L.

For example, FIG. 2A illustrates a case in which the first direction parallel to the axial line L is the vertical direction, and the control element 2 interacts with the protrusion 14 from a horizontal direction X (the direction indicated by the white arrow in FIG. 2A) which is orthogonal to this first direction.

In the present embodiment, in order to generate reaction forces of different magnitudes when the control element 2 interacts with the protrusion 14 from this direction (hereinafter, a "second direction X1") different from the first direction parallel to the axial line L and the protrusion 14 tilts towards the downstream side of the movement direction of the control element 2 (hereinafter, a "first position side") as well as when the control element 2 interacts with the protrusion 14 from a direction (hereinafter, a "third direction X2") different from both the first direction and the second direction X1 and the protrusion 14 tilts towards the downstream side of the movement direction of the control element 2 (hereinafter, a "second position side"), a portion (hereinafter, a "first region Ar1") of the hollow elastic member 12 on the first position side and a portion (hereinafter, a "second region Ar2") of the hollow elastic member 12 on the second position side are formed such that at least one of the shape characteristics and material properties thereof are different.

For example, in FIGS. 1B and 2A, the first region Ar1 of the outer wall of the hollow elastic member 12 is a thick-walled portion 121, and the second region Ar2 is a thin-walled portion 122 having a smaller wall thickness than the first region Ar1.

Due to the wall thickness of the first region Ar1 of the hollow elastic member 12 being formed to be greater than the wall thickness of the second region Ar2, as described above, the reaction force generated by the reaction force generator 1 is greater when the control element 2 interacts with the protrusion 14 from the second direction X1 than when the control element 2 interacts with the protrusion 14 from the third direction X2.

Note that although in the present embodiment as described below the third direction X2 is the direction opposite to the second direction X1 and the control element 2 makes back-and-forth movements in the horizontal direction X indicated by the white arrows in FIG. 2A as an example, the second direction X1 and the third direction X2 are not limited to being opposite directions but may be any mutually different directions.

Moreover, the second direction X1 and the third direction X2 may be thought of as being horizontal directions orthogonal to the axial line L (first direction), or the second direction X1 and the third direction X2 may be thought of as having the same angle of inclination (including 0°) with respect to a plane for which the axial line L (first direction) is a perpendicular line, where the third direction is a direction obtained by rotating the second direction about an axis corresponding to this perpendicular line.

Furthermore, the hollow elastic member 12 is formed such that the relationship between the displacement of the control element 2 and the reaction force of the hollow elastic member 12 is not a monotonically increasing relationship for at least one case among the case in which the control element 2 interacts with the protrusion 14 from the second direction X1 and the case in which the control element 2 interacts with the protrusion 14 from the third direction X2.

More specifically, the hollow elastic member 12 is formed in a dome shape which curves in a convex manner in the initial state as illustrated in FIG. 1A and the like, for example. Moreover, the hollow elastic member 12 is formed such that in at least one case among the case in which the control element 2 interacts with the protrusion 14 from the second direction X1 and the case in which the control element 2 interacts with the protrusion 14 from the third direction X2, when the displacement of the control element 2 reaches a prescribed amount, at least one of the portion of the hollow elastic member 12 on the first position side (the first region Ar1) and the portion of the hollow elastic member 12 on the second position side (the second region Ar2) flexes (that is, buckles) in the direction opposite to the convex curve present in the initial state.

As will be described later, in the present embodiment, the relationship between the displacement of the control element 2 and the reaction force of the hollow elastic member 12 is not a monotonically increasing relationship for both cases among the case in which the control element 2 interacts with the protrusion 14 from the second direction X1 and the case in which the control element 2 interacts with the protrusion 14 from the third direction X2. For example, when the control element 2 interacts with the protrusion 14 from the second direction X1, as soon as the displacement of the control element 2 reaches a prescribed amount, the first region Ar1 is depressed and undergoes buckling deformation. Similarly, when the control element 2 interacts with the protrusion 14 from the third direction X2, as soon as the displacement of the control element 2 reaches a prescribed amount, the second region Ar2 is depressed and undergoes buckling deformation.

Figure 2B:
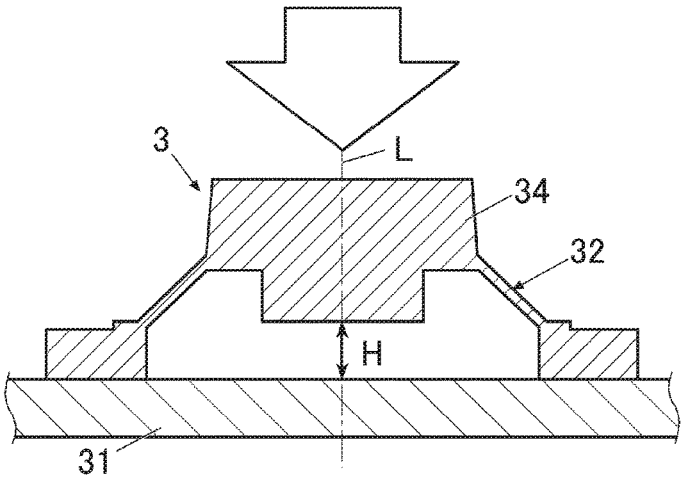
FIG. 2B is a cross-sectional side view illustrating an example of a conventional reaction force generator.

FIG. 2B is a cross-sectional side view illustrating an example of a conventional reaction force generator.

In the conventional reaction force generator 3 illustrated in FIG. 2B, a hollow elastic member 32 made of an elastic material such as a rubber is formed on top of a base 31, and a protrusion 34 is formed on top of this hollow elastic member 32.

In the conventional example illustrated in FIG. 2B, letting an axial line L be set to the direction going from the free end of the protrusion 34 (the upper end in the conventional example illustrated in FIG. 2B) towards the hollow elastic member 32, the protrusion 34 is depressed in a first direction parallel to this axial line L (the direction indicated by the white arrow in FIG. 2B) in order to generate a reaction force.

Figure 3A:
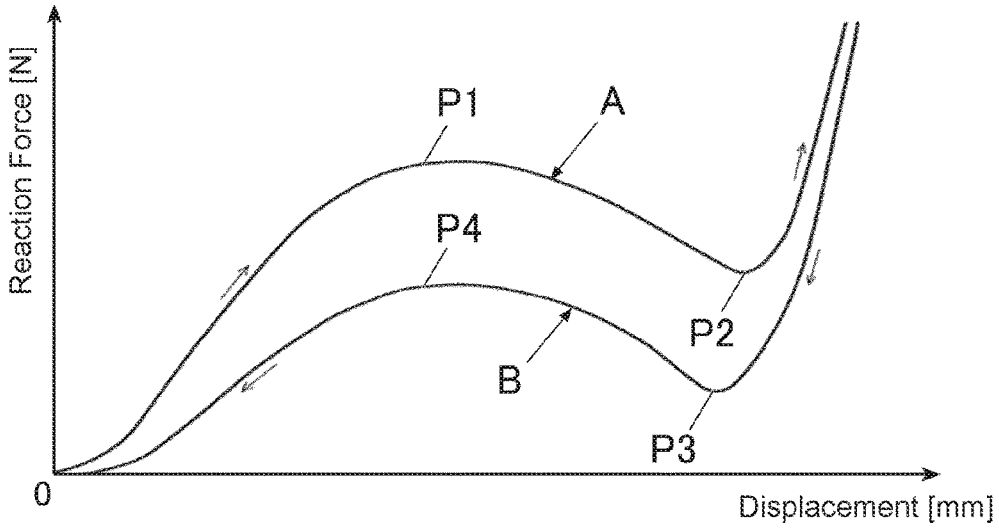
FIG. 3A is a graph illustrating an example of the stroke-reaction force characteristic curve of the conventional reaction force generator.

FIG. 3A is a graph illustrating an example of a characteristic curve (that is, a "stroke-reaction force characteristic curve"; hereinafter, also referred to as a "reaction force curve") representing the relationship between displacement (that is, depression stroke length) and the reaction force generated by the reaction force generator in the conventional reaction force generator.

In FIG. 3A, the horizontal axis is displacement (that is, depression stroke length), and the vertical axis is reaction force. Moreover, in this graph, curve A represents an outgoing path corresponding to the protrusion 34 being depressed, and curve B represents a return path corresponding to the protrusion 34 returning to its original initial state after being depressed.

Figure 3B:
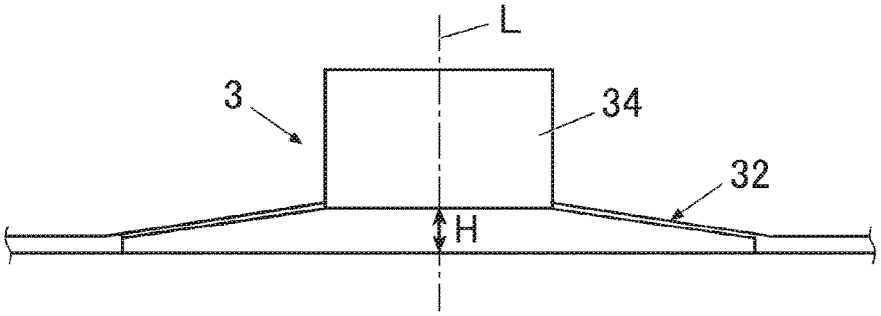
FIG. 3B is a schematic drawing illustrating an initial state of the conventional reaction force generator.
Figure 3C:
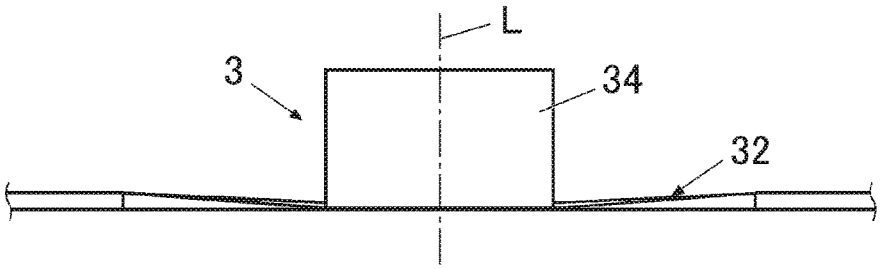
FIG. 3C is a schematic drawing illustrating a depressed state of the conventional reaction force generator.

Furthermore, FIG. 3B illustrates the initial state of the protrusion of the reaction force generator prior to being depressed, and FIG. 3C illustrates the state after the protrusion is depressed.

Next, the stroke-reaction force characteristic curve (reaction force curve) illustrated in FIG. 3A will be described with reference to FIGS. 3B and 3C.

Starting from the initial state illustrated in FIG. 3B, when the protrusion 34 of the reaction force generator 3 is gradually depressed downwards, the reaction force gradually increases, and when the depression stroke length reaches a prescribed value, the outer wall of the hollow elastic member 32 buckles. This corresponds to the peak P1 in the reaction force curve illustrated in FIG. 3A. Next, upon passing P2 in FIG. 3A, the bottom end of the protrusion 34 contacts the base 31 (that is, takes the state illustrated in FIG. 3C), and the reaction force takes a maximum value. Once depression of the protrusion 34 is terminated, the protrusion 34 returns in a direction moving away from the base 31, and the reaction force gradually decreases. Then, upon passing P3 in FIG. 3A, the buckled outer wall of the hollow elastic member 32 returns to the original shape, at which point the reaction force increases again as illustrated by P4 in FIG. 3A. Finally, when the protrusion 34 returns to its original initial position, the reaction force becomes equal to zero.

As illustrated in FIGS. 2B and 3B, when the protrusion 34 in this conventional example is depressed in the first direction parallel to the axial line L in order to generate a reaction force, the stroke length in the depression direction is only equal to the distance H that the bottom end of the protrusion 34 travels until contacting the base 31.

When the stroke is short as in the configuration of this conventional example, it is difficult to freely control the position, reaction force, and the like at which the clicking feeling is produced within the stroke range.

Moreover, this type of reaction force generator 3 only allows a simple back-and-forth motion in which the protrusion 34 is depressed in its outgoing path until the bottom end of the protrusion 34 contacts the base 31 and the protrusion 34 returns to its original position in its return path. Therefore, although in the stroke-reaction force characteristic curve (reaction force curve) the reaction force on the return path (returning to the initial state) is slightly lower than the reaction force on the outgoing path (during depression), both paths produce similar parallel curves, and the stroke-reaction force characteristics cannot be freely controlled along the outgoing path and the return path.

<Operation of Reaction Force Generator>

Figure 4:
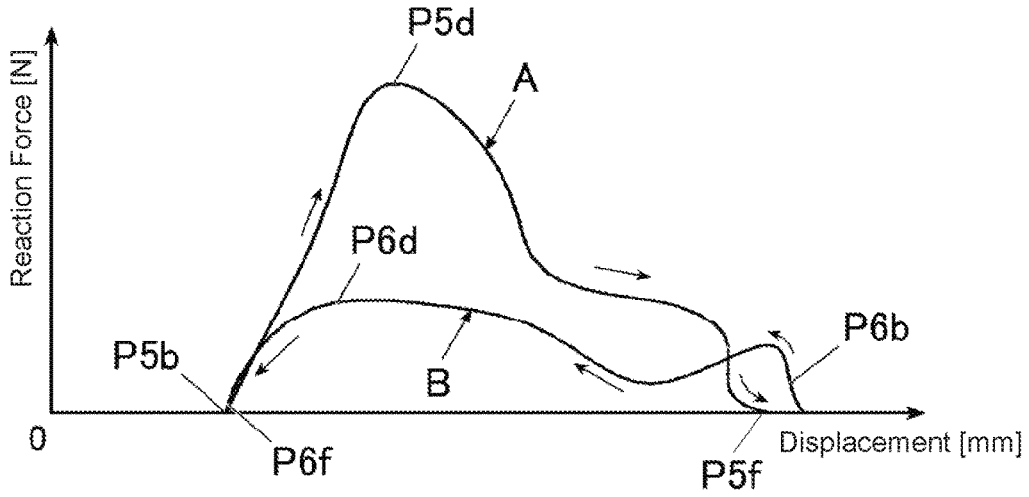
FIG. 4 is a graph illustrating an example of the stroke-reaction force characteristic curve of the reaction force generator according to the embodiment.

In contrast, FIG. 4 is a graph illustrating an example of a characteristic curve representing the relationship between displacement (press stroke) and the reaction force generated by the reaction force generator (stroke-reaction force characteristic curve (reaction force curve)) in the reaction force generator according to the present embodiment.

Similar to in FIG. 3A, in FIG. 4 the horizontal axis is displacement of the control element 2 (that is, press stroke length), and the vertical axis is reaction force. Moreover, in this graph, curve A represents the case in which the control element 2 interacts with the protrusion 14 from the second direction X1 (that is, along an outgoing path corresponding to when the protrusion 14 is pressed towards the first position side (the downstream side of the second direction X1)), and curve B represents the case in which the control element 2 interacts with the protrusion 14 from the third direction X2 (that is, along a return path corresponding to when the protrusion 14 is pressed towards the second position side (the downstream side of the third direction X2)).

Here, the curves produced by both paths are not similar parallel curves and even have positions where the relationship between the magnitudes of the reaction forces on the outgoing path and the return path is reversed.

FIGS. 5A to 5F are explanatory drawings illustrating, in chronological order, how the control element moves on the outgoing path and how the reaction force generator elastically deforms in response.

FIGS. 6A to 6F are explanatory drawings illustrating, in chronological order, how the control element moves on the return path and how the reaction force generator elastically deforms in response.

Figure 5A:
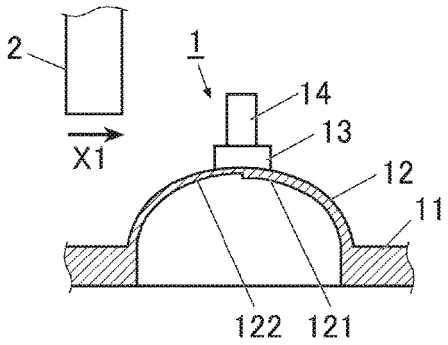
FIGS. 5A to 5F are explanatory drawings illustrating an interaction with the control element on an outgoing path and how the reaction force generator deforms in response.
Figure 5B:
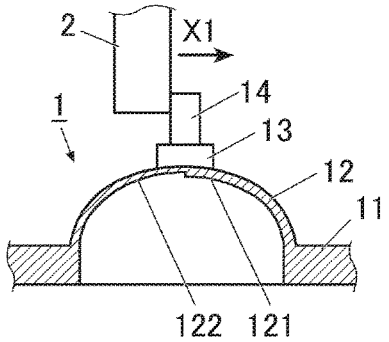
Figure 5C:
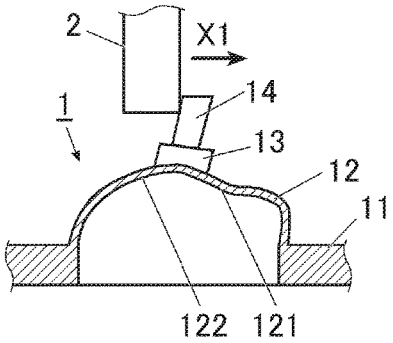

In the reaction force generator 1 of the present embodiment, on the outgoing path on which the control element 2 interacts with the protrusion 14 from the second direction X1, when the control element 2 moves (is displaced) from a state of not contacting the protrusion 14 (the state illustrated in FIG. 5A) to a position where the control element 2 contacts the protrusion 14 as illustrated in FIG. 5B, the reaction force begins to increase, as illustrated by P5*b* in FIG. 4. Then, as the control element 2 continues to move (be displaced) in the second direction X1, the protrusion 14 gradually begins to tilt towards the first position side (the downstream side of the second direction X1) (FIG. 5C and the like).

As the protrusion 14 gradually tilts towards the first position side (the downstream side of the second direction X1) in this manner, the first region Ar1 of the hollow elastic member 12 begins to be depressed and deform (FIG. 5C and the like), thereby gradually generating a reaction force resulting from this deformation.

Figure 5D:
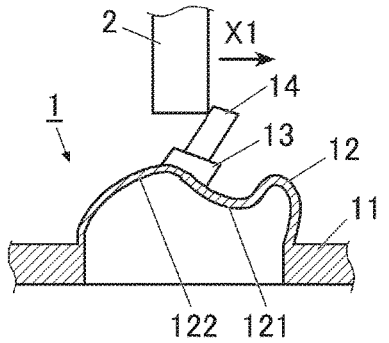
Figure 5E:
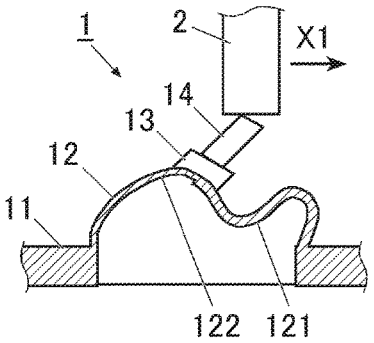
Figure 5F:
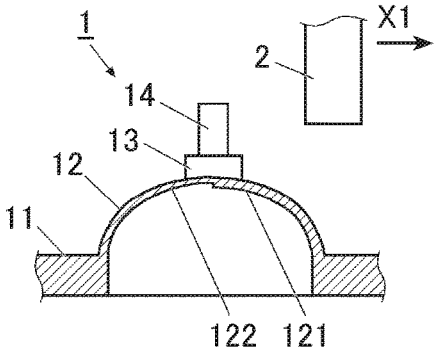

Furthermore, when the displacement (press stroke length) of the control element 2 reaches a prescribed amount, the first region Ar1 of the hollow elastic member 12 is depressed and undergoes buckling deformation (FIG. 5D).

In the present embodiment, the first region Ar1 of the hollow elastic member 12 is the thick-walled portion 121 formed to have a relatively large wall thickness, and therefore as illustrated by P5*d* in FIG. 4, the buckling deformation of this first region Ar1 produces a significant reaction force which then decreases rapidly, thereby creating a clicking feeling.

The buckling hollow elastic member 12 then continues to be depressed further as the displacement (movement) of the control element 2 continues (FIG. 5E and the like), but the resulting reaction force gradually decreases and stabilizes.

Finally, when the control element 2 reaches a position where the control element 2 no longer contacts the protrusion 14 (FIG. 5F), the reaction force becomes equal to zero, as illustrated by P5*f* in FIG. 4.

Figure 6A:
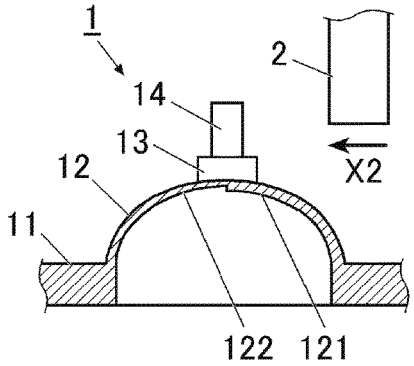
FIGS. 6A to 6F are explanatory drawings illustrating an interaction with the control element on a return path and how the reaction force generator deforms in response.
Figure 6B:
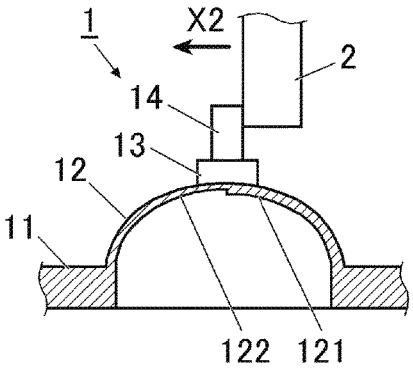

Next, in the reaction force generator 1 of the present embodiment, on the return path on which the control element 2 interacts with the protrusion 14 from the third direction X2, when the control element 2 moves (is displaced) from a state of not contacting the protrusion 14 (the state illustrated in FIG. 6A) to a position where the control element 2 contacts the protrusion 14 as illustrated in FIG. 6B, the reaction force begins to increase, as illustrated by P6*b* in FIG. 4.

Figure 6C:
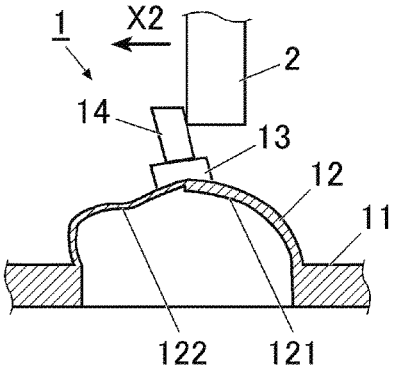

Here, as the control element 2 continues to move (be displaced) in the third direction X2, the protrusion 14 gradually tilts towards the second position side (the downstream side of the third direction X2) and causes the second region Ar2 of the hollow elastic member 12 to deform (FIG. 6C and the like). However, because the second region Ar2 is the thin-walled portion 122 formed to have a relatively small wall thickness, the reaction force generated by this deformation is smaller than that on the outgoing path.

Figure 6D:
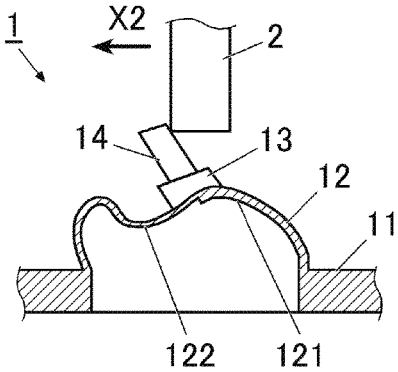
Figure 6E:
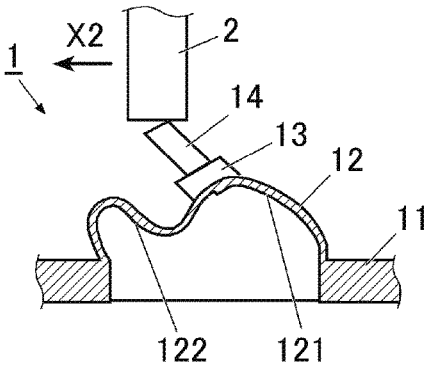
Figure 6F:
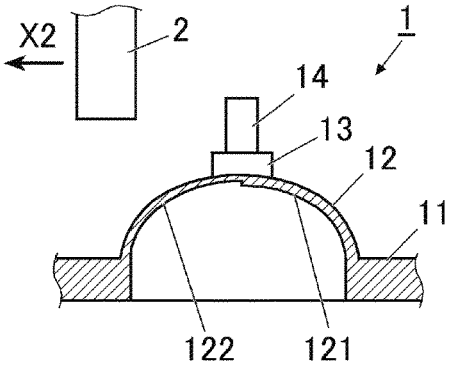

Then, when the displacement (press stroke length) of the control element 2 reaches a prescribed amount, the second region Ar2 of the hollow elastic member 12 is depressed and undergoes buckling deformation (FIG. 6D).

Here, the second region Ar2 of the hollow elastic member 12 is the thin-walled portion 122, and therefore as illustrated by P6*d* in FIG. 4, even when this second region Ar2 undergoes buckling deformation, the reaction force generated is not as large as that generated when the first region Ar1 undergoes buckling deformation, and no clicking feeling is created.

The buckled hollow elastic member 12 then continues to be depressed further as the displacement (movement) of the control element 2 continues (FIG. 6E and the like), but the resulting reaction force gradually decreases and stabilizes.

Finally, when the control element 2 reaches a position where the control element 2 no longer contacts the protrusion 14 (FIG. 6F), the reaction force becomes equal to zero, as illustrated by P6*f* in FIG. 4.

Thus, in the reaction force generator 1 of the present embodiment, the manner in which reaction force is generated differs significantly depending on the direction in which the control element 2 interacts with the protrusion 14, and whereas a clicking feeling is created on the outgoing path on which the control element 2 moves (is displaced) in the second direction X1, no clicking feeling is created on the return path on which the control element 2 moves (is displaced) in the third direction X2.

Moreover, the configuration (in the present embodiment, wall thickness) of the hollow elastic member 12 is different for the first region Ar1 and the second region Ar2, and therefore unlike in the conventional reaction force generator 3, the stroke-reaction force characteristic curve (reaction force curve) of the outgoing path and the stroke-reaction force characteristic curve (reaction force curve) of the return path are not parallel and even intersect with one another at a certain point.

Note that the stroke-reaction force characteristic curves (reaction force curves) illustrated in FIG. 4 are only examples. The reaction force generator 1 of the present embodiment can be configured to have any of various types of stroke-reaction force characteristic curves (reaction force curves) by changing how the hollow elastic member 12 is configured or the like.

<Effects of Reaction Force Generator>

As described above, in the reaction force generator 1 of the present embodiment, which includes the hollow elastic member 12 formed to be hollow using an elastically deformable material as well as the protrusion 14 protruding from the outer surface of the hollow elastic member 12, when letting the axial line L be set to the direction going from the free end of the protrusion 14 towards hollow elastic member 12, in order to generate reaction forces of different magnitudes when the control element 2 interacts with the protrusion 14 from the second direction X1 which is different from the first direction parallel to the axial line L and causes the protrusion 14 to tilt towards the first position side and when the control element 2 interacts with the protrusion 14 from the third direction X2 which is opposite to the second direction X1 and causes the protrusion 14 to tilt towards the second position side, the first region Ar1 which is the portion of the hollow elastic member 12 on the first position side and the second region Ar2 which is the portion of the hollow elastic member 12 on the second position side are formed to have different configurations (in terms of shape characteristics or material properties).

Therefore, the stroke-reaction force characteristic curve representing the relationship between the stroke length of the control element 2 and the reaction force generated by the reaction force generator 1 can be configured to be different for the outgoing path and the return path of the control element 2 by using a simple approach such as partially changing the wall thickness of the hollow elastic member 12. This makes it possible to freely control the reaction force characteristics of the reaction force generator 1 so as to create a clicking feeling on the outgoing path and minimize the clicking feeling or any resistance on the return path, for example. This in turn makes it possible to expand the utility of and potential applications for the reaction force generator 1.

Furthermore, in the present embodiment, the hollow elastic member 12 is formed such that the relationship between the displacement of the control element 2 and the reaction force of the hollow elastic member 12 is not a monotonically increasing relationship both when the control element 2 interacts with the protrusion 14 from the second direction X1 and when the control element 2 interacts with the protrusion 14 from the third direction X2.

Therefore, the reaction force generated by the reaction force generator 1 as the control element 2 is displaced (moves) can be adjusted both for the outgoing path and for the return path.

In particular, in the present embodiment, the hollow elastic member 12 is formed in a dome shape which curves in a convex manner in the initial state. Moreover, the hollow elastic member 12 is formed such that both when the control element 2 interacts with the protrusion 14 from the second direction X1 and when the control element 2 interacts with the protrusion 14 from the third direction X2, as soon as the displacement of the control element 2 reaches a prescribed amount, at least one of the first region Ar1 which is the portion of the hollow elastic member 12 on the first position side and the second region Ar2 which is the portion of the hollow elastic member 12 on the second position side flexes in the direction opposite to the convex curve present in the initial state.

This makes it possible to make the hollow elastic member 12 buckle and thereby generate a large change in reaction force when the displacement (movement distance) of the control element 2 reaches the prescribed amount, thereby making it possible to create a clicking feeling.

Moreover, the magnitude and the like of the clicking feeling can be freely adjusted by adjusting the wall thickness or the like of the buckling portions.

<Modification Examples of Reaction Force Generator>

Although one embodiment of the present invention was described above, the present invention is not limited to this embodiment, and various modifications can be made without departing from the spirit of the invention.

For example, the embodiment above describes an example in which, after interacting with the protrusion 14 from the second direction X1 and then clearing the protrusion 14 while on the outgoing path, the control element 2 temporarily takes a state which the control element 2 is separated from the protrusion 14 and does not contact the protrusion 14 (that is, a state in which the reaction force is zero), and then the control element 2 interacts with the protrusion 14 from the third direction X2 while on the return path. However, the control element 2 may be configured to not separate from the protrusion 14 between the outgoing path and the return path.

Figure 7:
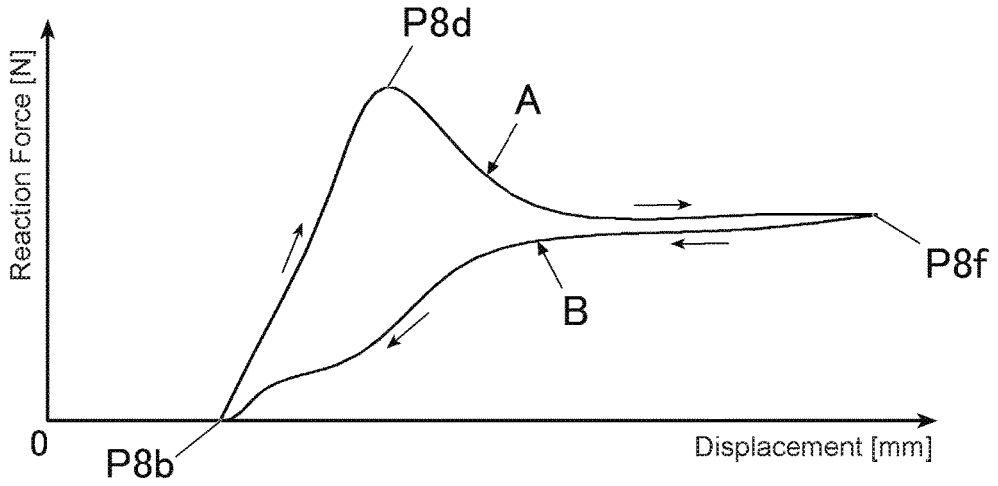
FIG. 7 is a graph illustrating an example of the stroke-reaction force characteristic curve of a reaction force generator according to a modification example.

FIG. 7 is a graph illustrating an example of a stroke-reaction force characteristic curve (reaction force curve) for a case in which after beginning to ride over the protrusion while on the outgoing path, the control element 2 immediately proceeds to move along the return path without separating from the protrusion 14, for example. FIGS. 8A to 8F are schematic drawings illustrating the relationship between the reaction force generator 1 and the control element 2 during this process.

Note that the configuration (shape characteristics and material properties) of the reaction force generator 1 illustrated in FIG. 7 and FIGS. 8A to 8F is the same as in the embodiment described above.

Figure 8A:
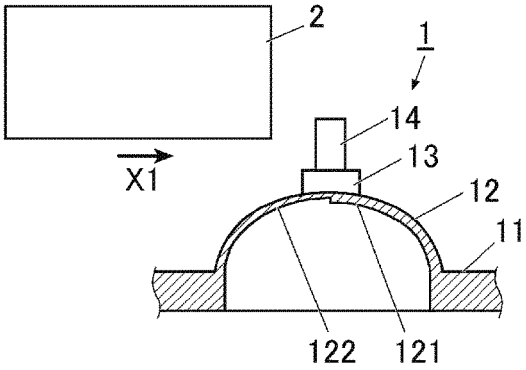
FIGS. 8A to 8F are explanatory drawings illustrating an interaction with the control element and how the reaction force generator deforms in response for the case corresponding to FIG. 7.

Meanwhile, as illustrated in FIG. 8A and the like, the control element 2 has a shape which contacts the protrusion 14 along a plane.

Figure 8B:
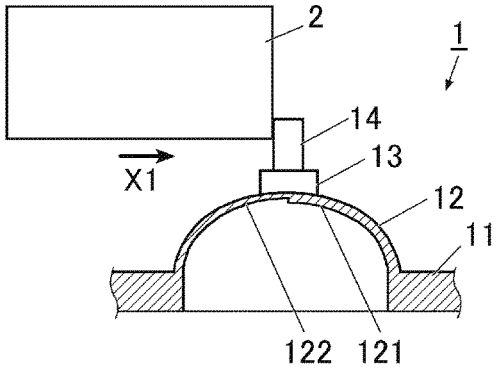
Figure 8C:
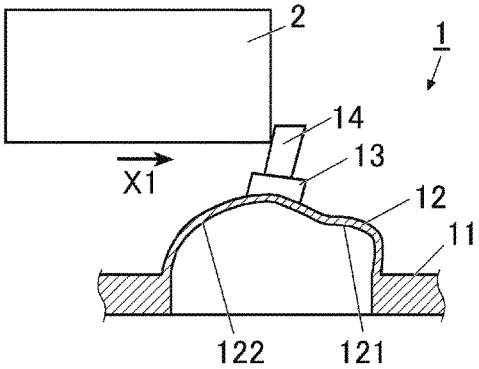

In this reaction force generator 1, on the outgoing path on which the control element 2 interacts with the protrusion 14 from the second direction X1, when the control element 2 moves (is displaced) from a state of not contacting the protrusion 14 (the state illustrated in FIG. 8A) to a position at which the control element 2 is brought into contact with the protrusion 14 as illustrated in FIG. 8B, the reaction force begins to increase, as illustrated by P8*b* in FIG. 7. Next, as the control element 2 continues to move (be displaced) in the second direction X1, the protrusion 14 gradually begins to tilt towards the first position side (the downstream side of the second direction X1) (FIG. 8C and the like).

As the protrusion 14 gradually tilts towards the first position side (the downstream side of the second direction X1) in this manner, the first region Ar1 of the hollow elastic member 12 begins to be depressed and deform (FIG. 8C and the like), thereby gradually generating a reaction force resulting from this deformation.

Figure 8D:
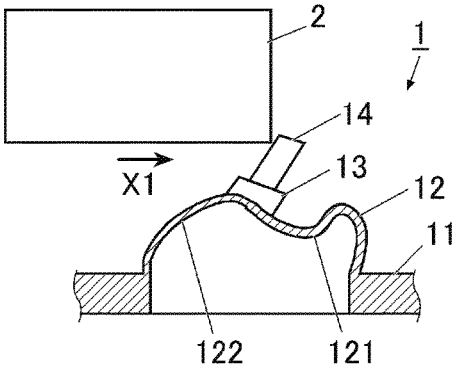
Figure 8E:
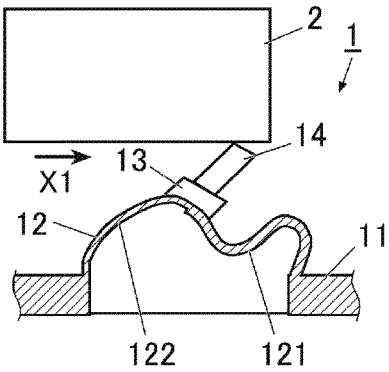

Then, when the displacement (press stroke length) of the control element 2 reaches a prescribed amount, the first region Ar1 of the hollow elastic member 12 is depressed and undergoes buckling deformation (FIG. 8D).

In this embodiment, the first region Ar1 of the hollow elastic member 12 is the thick-walled portion 121 formed to have a relatively large wall thickness, and therefore as illustrated by P8*d* in FIG. 7, the buckling deformation of this first region Ar1 produces a significant reaction force which then decreases rapidly, thereby creating a clicking feeling.

The buckling hollow elastic member 12 then continues to be depressed further as the displacement (movement) of the control element 2 continues (FIG. 8E and the like), but the resulting reaction force gradually decreases and stabilizes.

Figure 8F:
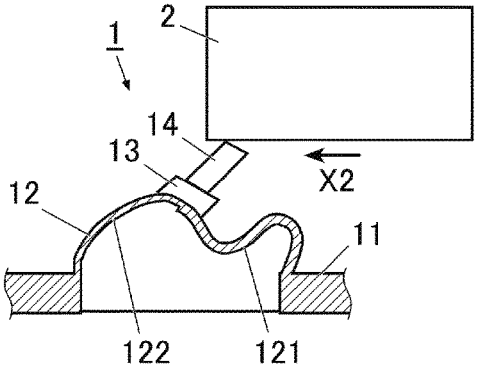

Next, upon reaching the end of the stroke on the outgoing path, the control element 2 changes movement direction while remaining in contact with the protrusion 14 and proceeds to interact with the protrusion 14 from the third direction X2 (FIG. 8F).

As illustrated by P8*f* in FIG. 7, when the control element 2 changes direction of movement (displacement) without separating from the protrusion 14 between the outgoing path and the return path in this manner, the reaction force remains at a fixed value as the control element 2 changes movement direction and begins returning. On the return path, the hollow elastic member 12 undergoes buckling deformation in the second region Ar2 positioned on the downstream side of the third direction X2. However, as described with reference to FIG. 6D and the like, the second region Ar2 is the thin-walled portion 122, and therefore the control element 2 smoothly returns to its initial position (that is, the position in FIG. 8A in which the control element 2 is not contacting the protrusion 14) without causing a large reaction force to be generated.

This configuration once again makes it possible to achieve a large difference between the stroke-reaction force characteristic curves (reaction force curves) for the outgoing path and the return path and to create a clicking feeling only on the outgoing path.

In conventional approaches, the clicking feeling is created by the control element 2 clearing the protrusion 14.

However, when the clicking feeling is created by the buckling deformation of the hollow elastic member 12 as in the present embodiment, positions at which the control element 2 clears the protrusion 14 do not necessarily need to be established on the outgoing path and return path of the control element 2.

Therefore, even when the control element 2 is not moved all the way to a position not contacting the protrusion 14, as in the example illustrated in FIG. 7 and FIGS. 8A to 8F, the control element 2 can still be configured to change direction of movement (displacement) without separating from the protrusion 14 between the outgoing path and the return path.

Moreover, if the hollow elastic member 12 is configured to be undergoing buckling deformation before the control element 2 contacts the protrusion 14, the control element 2 can be designed to stop at a position not contacting the protrusion 14 and then begin returning along the return path.

Thus, the present embodiment increases the degree of freedom in controlling the reaction force characteristics of the reaction force generator 1 in comparison to in conventional approaches and makes it possible to freely control these reaction force characteristics in accordance with the structure or intended usage or the like of the device into which the reaction force generator 1 will be incorporated.

Furthermore, the shape of the stroke-reaction force characteristic curve (reaction force curve) can be controlled by changing the shape of the portion of the control element 2 which makes contact with the protrusion 14.

Figure 9:
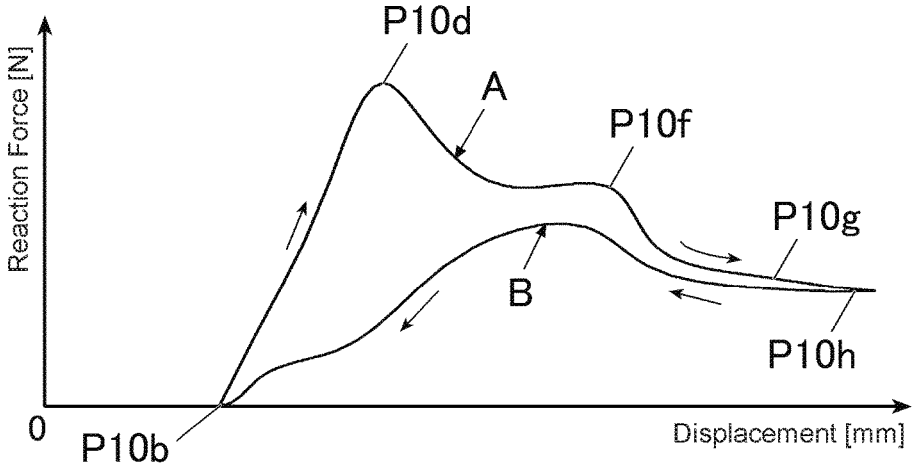
FIG. 9 is a graph illustrating an example of the stroke-reaction force characteristic curve of a reaction force generator according to a modification example.

For example, similar to FIG. 7 and the like, FIG. 9 is a graph illustrating an example of a stroke-reaction force characteristic curve (reaction force curve) for a case in which after beginning to ride over the protrusion while on the outgoing path, the control element 2 immediately proceeds to move along the return path without separating from the protrusion 14. FIGS. 10A to 10F are schematic drawings illustrating the relationship between the reaction force generator 1 and the control element 2 during this process.

Note that the configuration (shape characteristics and material properties) of the reaction force generator 1 illustrated in FIG. 9 and FIGS. 10A to 10F is once again the same as in the embodiment described above.

Figure 10A:
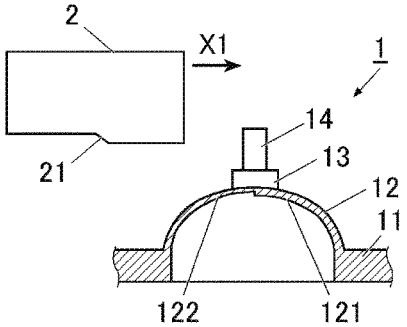
FIGS. 10A to 10H are explanatory drawings illustrating an interaction with the control element and how the reaction force generator deforms in response for the case corresponding to FIG. 9.

Meanwhile, as illustrated in FIG. 10A, the control element 2 has a shape which contacts the protrusion 14 along a plane, and a stepped portion 21 is formed in this plane which contacts the protrusion 14. Moreover, although the shape of the stepped portion 21 is not limited to the example illustrated in the figure, it is preferable that the corners of the stepped portion 21 be moderately slanted or rounded so that the control element 2 can smoothly ride over the protrusion 14 when moved while in contact with the protrusion 14.

Figure 10B:
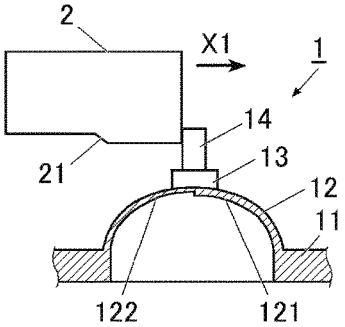
Figure 10C:
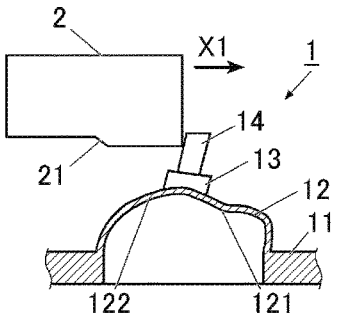

In the reaction force generator 1 illustrated in FIG. 10A and the like, on the outgoing path on which the control element 2 interacts with the protrusion 14 from the second direction X1, when the control element 2 moves (is displaced) from a state of not contacting the protrusion 14 (the state illustrated in FIG. 10A) to a position contacting the protrusion 14 as illustrated in FIG. 10B, the reaction force begins to increase, as illustrated by P10*b* in FIG. 9. Then, as the control element 2 continues to move (be displaced) in the second direction X1, the protrusion 14 gradually begins to tilt towards the first position side (the downstream side of the second direction X1) (FIG. 10C and the like).

As the protrusion 14 gradually tilts towards the first position side (the downstream side of the second direction X1) in this manner, the first region Ar1 of the hollow elastic member 12 begins to be depressed and deform (FIG. 10C and the like), thereby gradually generating a reaction force resulting from this deformation.

Figure 10D:
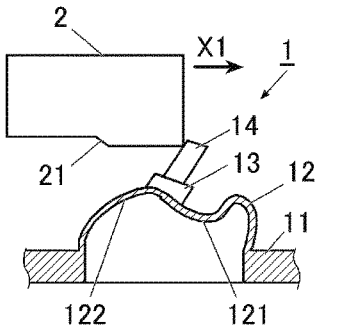
Figure 10E:
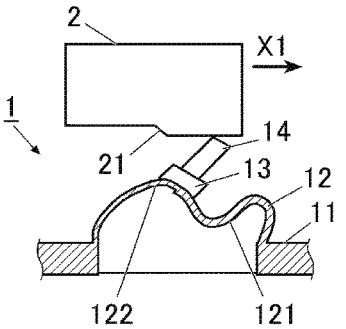
Figure 10F:
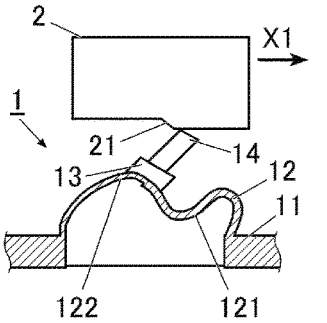

Furthermore, when the displacement (press stroke length) of the control element 2 reaches a prescribed amount, the first region Ar1 of the hollow elastic member 12 is depressed and undergoes buckling deformation (FIG. 10D).

In this embodiment, the first region Ar1 of the hollow elastic member 12 is the thick-walled portion 121 formed to have a relatively large wall thickness, and therefore as illustrated by P10*d* in FIG. 9, the buckling deformation of this first region Ar1 produces a significant reaction force which then decreases rapidly, thereby creating a clicking feeling.

The buckling hollow elastic member 12 then continues to be depressed further as the displacement (movement) of the control element 2 continues (FIG. 10E and the like), but the resulting reaction force gradually decreases and stabilizes.

Figure 10G:
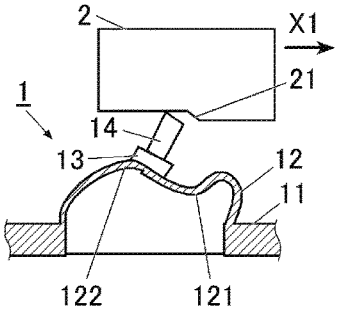

Furthermore, as illustrated by P10*f* in FIG. 9, when the control element 2 has the stepped portion 21 and this stepped portion 21 rides over the protrusion 14, a significant reaction force is generated, and then once the stepped portion 21 clears the protrusion 14 (FIG. 10G), the reaction force decreases rapidly, thereby creating a moderate clicking feeling.

Figure 10H:
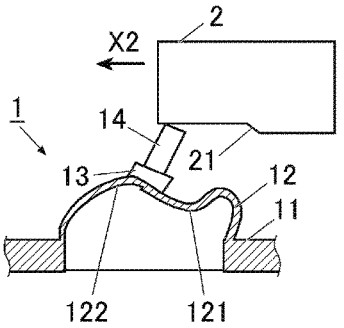

Upon reaching the end of the stroke on the outgoing path, the control element 2 changes movement direction while remaining in contact with the protrusion 14 and proceeds to interact with the protrusion 14 from the third direction X2 (FIG. 10H).

As illustrated by P10*h* in FIG. 9, when the control element 2 changes direction of movement (displacement) without separating from the protrusion 14 between the outgoing path and the return path in this manner, the reaction force remains at a fixed value as the control element 2 changes movement direction and begins returning. Once again, on the return path, the hollow elastic member 12 undergoes buckling deformation in the second region Ar2 positioned on the downstream side of the third direction X2, and the stepped portion 21 rides over the protrusion 14 again. However, as described with reference to FIG. 6D and the like, the second region Ar2 is the thin-walled portion 122, and therefore the control element 2 smoothly returns to its initial position (that is, the position in which the control element 2 is not contacting the protrusion 14) without causing a large reaction force to be generated.

This configuration once again makes it possible to achieve a large difference between the stroke-reaction force characteristic curves (reaction force curves) for the outgoing path and the return path and to create a clicking feeling only on the outgoing path. Moreover, multiple clicking feelings can be created at arbitrary points in time by changing the shape of the control element 2.

In addition, the embodiment above describes an example in which the wall thickness of the hollow elastic member 12 is partially changed, such as by making the first region Ar1 of the hollow elastic member 12 be the thick-walled portion 121 and making the second region Ar2 be the thin-walled portion 122, in order to generate reaction forces of different magnitudes when the control element 2 interacts with the protrusion 14 from the second direction X1 and causes the protrusion 14 to tilt towards the first position side and when the control element 2 interacts with the protrusion 14 from the third direction X2 and causes the protrusion 14 to tilt towards the second position side. However, the method of changing the manner in which the reaction force is generated is not limited to this example.

The hollow elastic member 12 may be formed such that at least one of the shape characteristics and material properties thereof are different for the first region Ar1 which is the portion on the first position side and the second region Ar2 which is the portion on the second position side.

For example, when forming the regions of the hollow elastic member 12 to have different shape characteristics, shape characteristics such as the wall thickness, exterior shape, or interior shape of the regions may be changed.

Moreover, when forming the regions of the hollow elastic member 12 to have different material properties, the materials used for the regions or properties thereof such as density may be changed.

Furthermore, when changing the shape characteristics or material properties of the regions of the hollow elastic member 12, if it is difficult to form the overall hollow elastic member 12 as a single integrated component, the hollow elastic member 12 may be formed by assembling together a plurality of portions of different material, density, or shape. In this case, the plurality of portions of different material, density, shape, or the like can be joined using an adhesive or a similar approach.

For example, FIGS. 11A and 11B and FIGS. 12A and 12B illustrate examples of changing the interior shapes of each of the regions of the hollow elastic member 12.

Figure 11A:
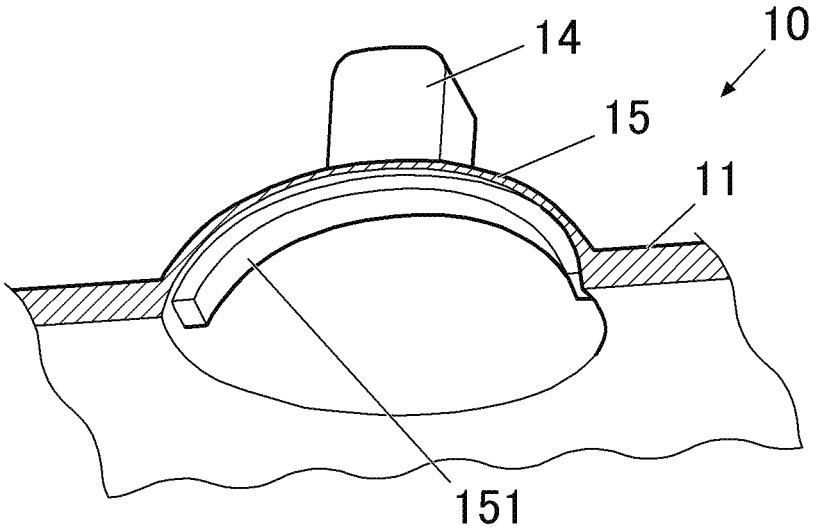
FIGS. 11A and 11B are cross-sectional perspective views illustrating modification examples of the reaction force generator.
Figure 11B:
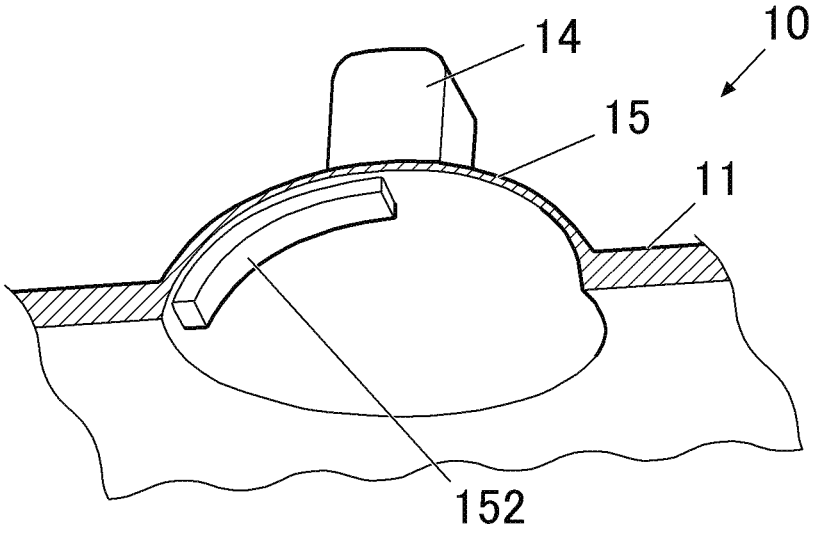

FIGS. 11A and 11B are cross-sectional perspective views illustrating examples in which a rib-shaped protrusion 151 or 152 is partially formed on an inner surface of a hollow elastic member 15 in a reaction force generator 10.

FIG. 11A illustrates an example in which a rib-shaped protrusion 151 is formed spanning across the entire inner surface of the hollow elastic member 15 in the left-right direction (that is, the left-right direction in FIG. 11A), and FIG. 11B illustrates an example in which a rib-shaped protrusion 152 is formed only on half of the inner surface of the hollow elastic member 15 in the left-right direction (on the left half in FIG. 11B).

The reaction forces generated when the rib-shaped protrusions 151 and 152 buckle are greater than the reaction force generated when portions where the rib-shaped protrusions 151 and 152 are not present (thin-walled portions or the like) buckle.

Therefore, appropriately adjusting and designing the position and span of the rib-shaped protrusions 151 and 152 as well as the associated buckling directions makes it possible to achieve desired reaction force characteristics in accordance with the intended use case.

In other words, in the example illustrated in FIG. 11A, when the hollow elastic member 15 is depressed and made to buckle in the left-right direction of the hollow elastic member 15 (the left-right direction in FIG. 11A), the resulting reaction force is large, and when the hollow elastic member 15 is depressed and made to buckle in the front-back direction of the hollow elastic member 15 (the front-back direction in FIG. 11A) which is orthogonal to the left-right direction, the resulting reaction force is smaller. Moreover, at intermediate positions between these directions, reaction forces of intermediate magnitude are generated. Thus, changing the interaction direction in which the protrusion 14 is tilted to adjust the direction in which the hollow elastic member 15 is made to buckle makes it possible to obtain reaction force characteristics of several different magnitudes.

Furthermore, in the example illustrated in FIG. 11B, when the hollow elastic member 15 is depressed towards and made to buckle on the left side of the hollow elastic member 15 (the left side in FIG. 11B), the resulting reaction force is large, and when the hollow elastic member 15 is depressed towards and made to buckle on the right side of the hollow elastic member 15 (the right side in FIG. 11B) which is opposite to this left side, the resulting reaction force is small. Thus, changing the interaction direction in which the protrusion 14 is tilted to adjust the direction in which the hollow elastic member 15 is made to buckle makes it possible to obtain different reaction force characteristics.

Figure 12A:
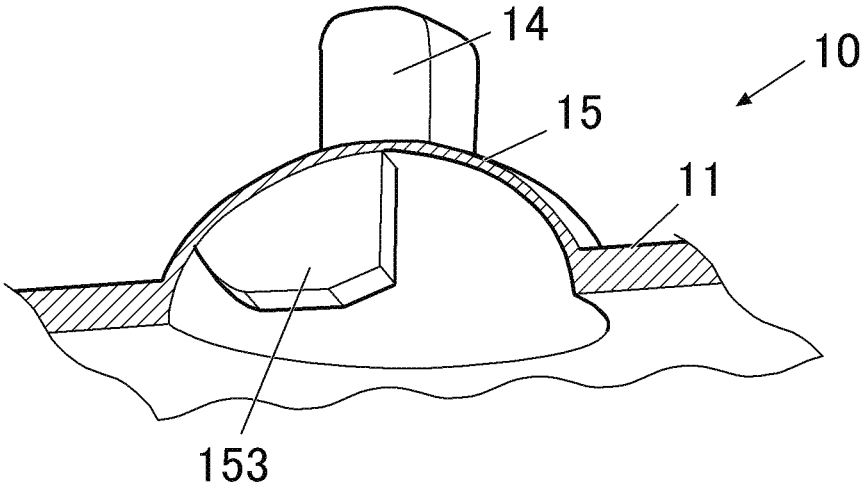
FIGS. 12A and 12B are cross-sectional perspective views illustrating a modification example of the reaction force generator.
Figure 12B:
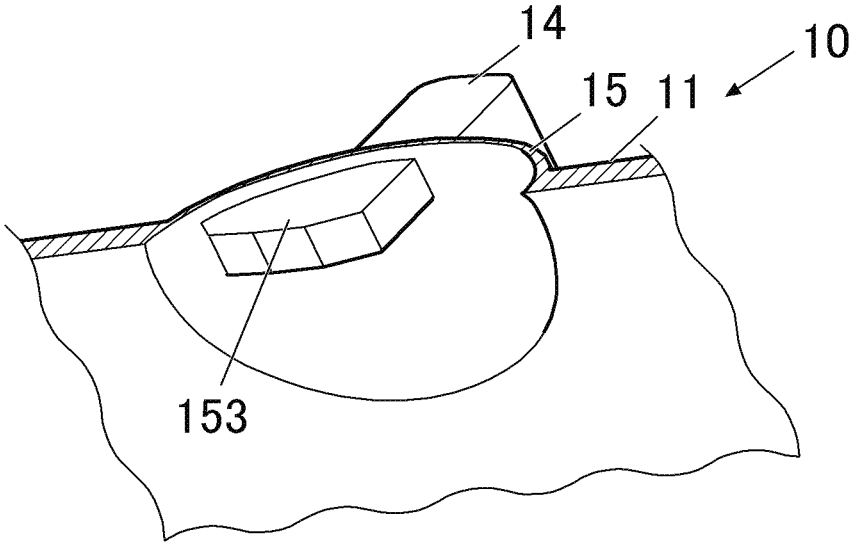

Furthermore, FIGS. 12A and 12B illustrate an example in which a plate-shaped protrusion 153 extending in the height direction of the hollow elastic member 15 and having a bottom end contacting the base 11 is partially formed on the inner surface of the hollow elastic member 15 of the reaction force generator 10, where FIG. 12A is a cross-sectional perspective view from a side direction and FIG. 12B is a cross-sectional perspective view of the hollow elastic member 15 from a perspective angle therebeneath.

In the example illustrated in FIGS. 12A and 12B, the plate-shaped protrusion 153 is formed only on approximately half of the inner surface of the hollow elastic member 15 in the left-right direction (the left half in FIGS. 12A and 12B).

As illustrated in FIGS. 12A and 12B, when this type of plate-shaped protrusion 153 which contacts the upper surface of the base 11 forming the base surface of the hollow elastic member 15 is formed, upon depressing and attempting to make the hollow elastic member 15 buckle on the side on which the plate-shaped protrusion 153 is present, the reaction force increases dramatically.

Therefore, appropriately adjusting and designing the position and span of the plate-shaped protrusion 153 as well as the associated buckling directions makes it possible to achieve desired force characteristics in accordance with the intended use case.

Moreover, although the embodiment above described an example in which the hollow elastic member 12 had a substantially hemispherical dome shape, the specific external shape of the hollow elastic member 12 is not limited to this example and can be appropriately designed in accordance with the desired stroke-reaction force characteristics, and various types of shapes can be used.

Figure 13A:
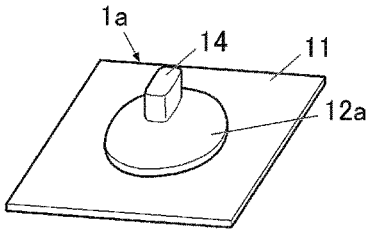
FIGS. 13A to 13I are perspective views illustrating modification examples of the reaction force generator.

For example, as illustrated in FIG. 13A, a hollow elastic member 12*a* of a reaction force generator 1*a* may have a thin disk shape.

In the present embodiment, a reaction force is generated by pressing the protrusion 14 in a direction different from the first direction parallel to the axial line L connecting the protrusion 14 and the hollow elastic member 12*a*, and therefore even when the height of the hollow elastic member 12*a* is small as illustrated in FIG. 13A, it is still possible to allocate sufficient stroke length in comparison to when pressing from the first direction parallel to the axial line L, and it is still possible to obtain sufficient functionality from the reaction force generator 1*a*.

Figure 13B:
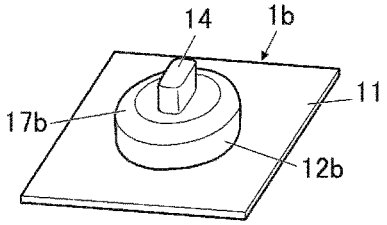

Moreover, as illustrated in FIG. 13B, a reaction force generator 1*b* may have a cylinder-shaped hollow elastic member 12*b*, for example. Although here in FIG. 13B a slanted surface 17*b* is formed cutting off the outer edge of the upper surface of the hollow elastic member 12*b*, a configuration in which this slanted surface 17*b* is not formed may also be used. Furthermore, the upper corner of the cylinder-shaped hollow elastic member 12*b* may be rounded instead of forming the slanted surface 17*b*.

Figure 13C:
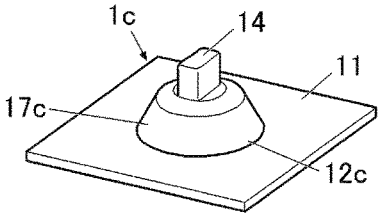

In addition, as illustrated in FIG. 13C, a reaction force generator 1*c* may have a cone-shaped hollow elastic member 12*c* in which a slanted surface 17*c* is swept around the circumference of a cylinder, for example.

Figure 13D:
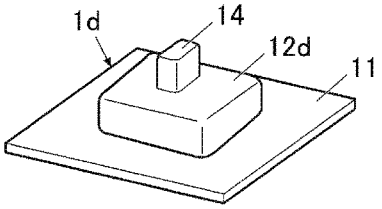
Figure 13E:
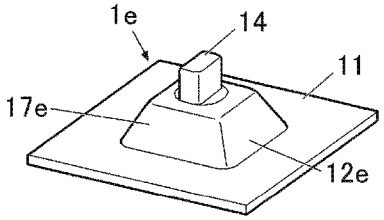

Moreover, as illustrated in FIG. 13D, a reaction force generator 1*d* may have a square prism-shaped hollow elastic member 12*d*, or as illustrated in FIG. 13E, a reaction force generator 1*e* may have a square pyramid-shaped hollow elastic member 12*d* in which a slanted surface 17*e* is swept around the circumference of a square prism. Here, note that the hollow elastic member 12 does not necessarily need to have a square prism shape or a square pyramid shape and may have various types of polygonal prism shapes or polygonal pyramid shapes.

Figure 13F:
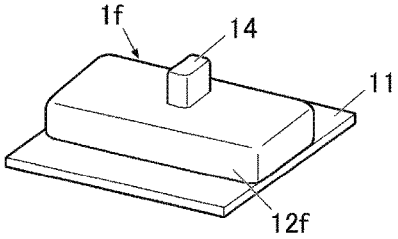
Figure 13G:
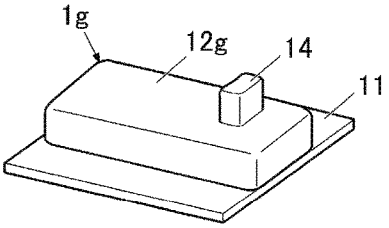

Furthermore, as illustrated in FIG. 13F, a reaction force generator if may have a rectangular prism-shaped hollow elastic member 12*f*, for example. In this case, as illustrated in FIG. 13G, a protrusion 14 of a reaction force generator 1*g* may be arranged at a position offset from the center of the upper surface of a hollow elastic member 12*g*.

Figure 13H:
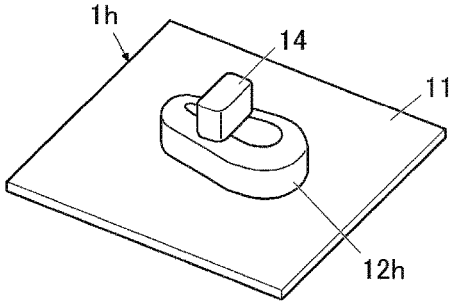
Figure 13I:
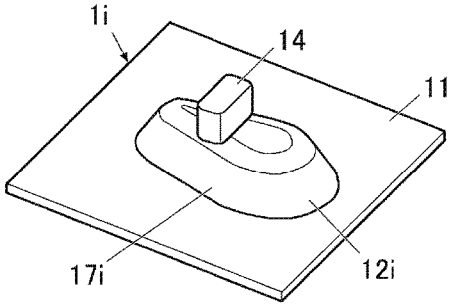

In addition, as illustrated in FIG. 13H, a reaction force generator 1*h* may have a hollow elastic member 12*h* of a shape obtained by joining together a plurality of cylinders, or as illustrated in FIG. 13I, a reaction force generator 1*i* may have a hollow elastic member 12*i* of a shape obtained by joining together a plurality of cones and having a slanted surface 17*i* around the circumference thereof, for example. Here, cylinders or prisms of the same size may be joined together, or cylinders or prisms of different sizes may be joined together. Moreover, the number of shapes joined together is not limited to being two shapes, and three or more shapes may be joined together.

Furthermore, the reaction force characteristics may be adjusted by partially changing the height of the hollow elastic member 12 or the length from the protrusion 14.

For example, a hollow elastic member 12 of smaller height makes it possible to reduce the reaction force generated when the hollow elastic member 12 is pressed and deforms or buckles. Alternatively, increasing the length from the protrusion 14 to the outer edge of the hollow elastic member 12 similarly makes it possible to reduce the reaction force generated when the hollow elastic member 12 is pressed and deforms or buckles.

Furthermore, in addition to the example approaches described above, the reaction force characteristics may be configured to be different for the first region Ar1 which is the portion of the hollow elastic member 12 on the first position side and the second region Ar2 which is the portion of the hollow elastic member 12 on the second position side by partially changing the material properties of the materials used to form the hollow elastic member 12 in order to create a higher-rigidity portion and a lower-rigidity portion.

In addition, the reaction force characteristics of the reaction force generator 1 may be adjusted through combinations of some or all of various factors including shape characteristics of the hollow elastic member 12 such as wall thickness, exterior shape, and interior shape as well as material properties of the hollow elastic member 12 such as material and density.

Moreover, in addition to changing the shape characteristics or the like of the hollow elastic member 12 of the reaction force generator 1, the shape of the control element 2 which interacts with the protrusion 14 or the direction in which the control element 2 performs this interaction may also be changed as well.

Changing conditions related to the control element 2 as well makes it possible to achieve a wider variety of adjustments to the reaction force characteristics of the reaction force generator 1.

Furthermore, in addition to changing the shape characteristics or the like of the hollow elastic member 12, the shape, rigidity, position, or the like of the protrusion 14 may also be adjusted as well. Also adjusting the shape or the like of the protrusion 14 in this manner makes it possible to more freely fine-tune the stroke-reaction force characteristics.

In addition, although the embodiment above describes examples in which the reaction force generator 1 is configured to have different stroke-reaction force characteristics in two directions (the outgoing path and return path of the control element 2), the number of directions having different stroke-reaction force characteristics is not limited to two directions.

When the reaction force generator 1 is applied to various types of switch devices or the like, by dividing the hollow elastic member 12 into three or more regions and forming these regions to have different shape characteristics or material properties, the stroke-reaction force characteristics can be changed in multiple (three or more) directions, thereby making it possible to achieve a wide variety of switching operations.

For example, the hollow elastic member 12 may be divided in four directions into a first region to a fourth region, and these regions may be formed to have different shape characteristics or material properties. In this case, applying the reaction force generator 1 to a device such as a game controller for performing operations in four directions (front, back, left, and right) would make it possible to achieve different operational feelings in each direction.

Moreover, even if the hollow elastic member 12 is not divided into a plurality of distinct regions of different shape characteristics or material properties, the hollow elastic member 12 may be configured such that the shape characteristics or material properties thereof change gradually in different directions.

<Example Configuration of Electronic Keyboard Instrument Including Reaction Force Generator>

Next, an example configuration of applying the reaction force generator 1 described above to an electronic keyboard instrument will be described with reference to FIGS. 14 and 15.

Figure 14:
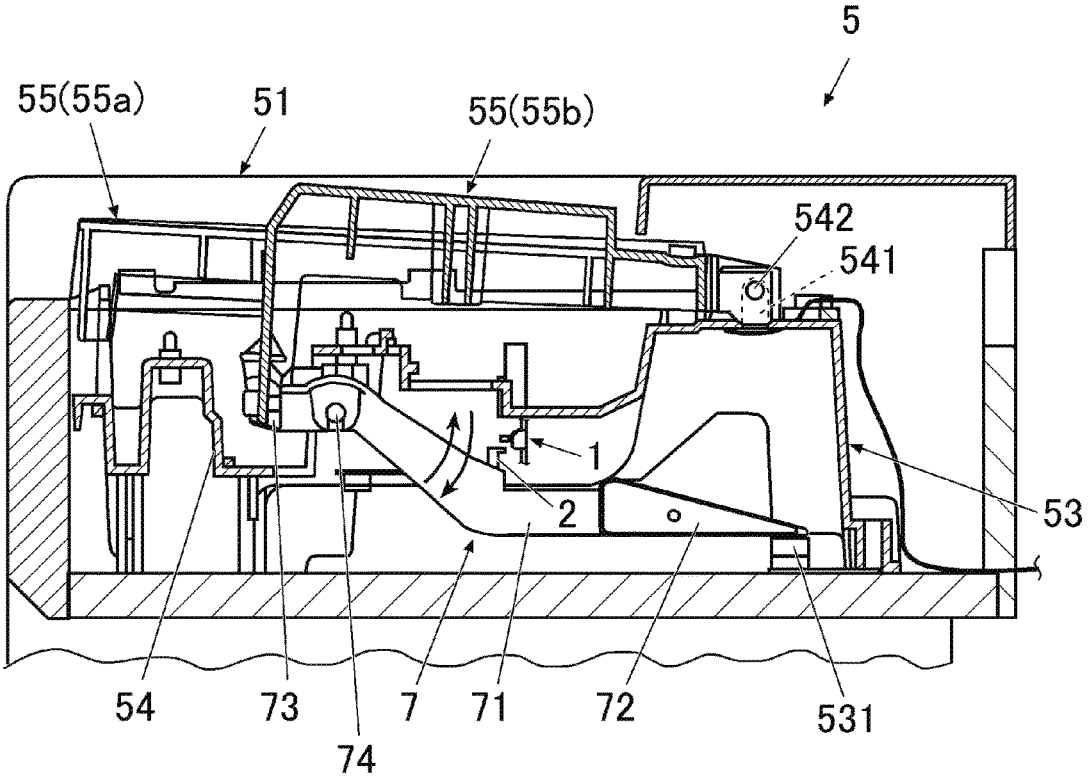
FIG. 14 is a cross-sectional side view of an electronic keyboard instrument according to an embodiment of the present invention.

FIG. 14 is a cross-sectional side view of an electronic keyboard instrument according to the present embodiment.

An electronic keyboard instrument 5 of the present embodiment is an electronic piano or keyboard or the like, for example.

As illustrated in FIG. 14, the electronic keyboard instrument 5 includes a key 55, which undergoes a swinging motion when pressed and released, the reaction force generator 1 described above and the control element 2 which is moved (displaced) in accordance with the movement of the key 55. There is actually a plurality of this structure in the keyboard instrument 5.

In this electronic keyboard instrument 5, a main instrument unit 53 is housed within a case 51, and the main instrument unit 53 includes a large number of the keys 55 (white keys 55*a* and black keys 55*b*) arranged on a keyboard chassis 54.

The rear end of each key 55 is rotatably attached via a rotating pivot 542 to a key support 541 formed near the rear end of the keyboard chassis 54. Moreover, hammers 7 respectively corresponding to the plurality of keys 55 are rotatably attached to the keyboard chassis 54 via a shaft 74.

Each hammer 7 includes an arm-shaped main hammer unit 71, a weight 72 formed on one end of the main hammer unit 71, and a locking portion 73 formed on the other end of the main hammer unit 71.

The locking portion 73 of each hammer 7 locks into the front end side of the respectively corresponding key 55.

When a keypress operation is performed by pressing one of the keys 55, the front end of the key 55 rotates in a downward direction about the rotating pivot 542 as the center of rotation, and the locking portion 73 of the hammer 7 which is locked into the front end of the key 55 is pushed downwards, thereby causing the main hammer unit 71 to rotate about the shaft 74 as the center of rotation such that the weight 72 moves in an upward direction. Moreover, when the keypress operation is ended and the key is released, the main hammer unit 71 rotates in a downward direction under the weight of the weight 72 and returns to an initial position in which the weight 72 rests on a hammer rest 531 formed within the main instrument unit 53.

Moreover, in the present embodiment, the reaction force generator 1 including the hollow elastic member 12 and the protrusion 14 as illustrated in FIGS. 1A and 1B and the like is arranged within the main instrument unit 53.

The control element 2 is arranged on the main hammer unit 71 of the hammer 7 so as to press the protrusion 14 of the reaction force generator 1 in the second direction X1 in response to a keypress operation and so as to then press the protrusion 14 in the third direction X2 in response to a key release operation.

In the present embodiment, the free end of the control element 2 which contacts the protrusion 14 has a substantially L-shaped hook shape.

Note that the control element 2 is not limited to having the shape illustrated in the example in FIG. 14 and the like and can have any shape that makes it possible to reliably press the protrusion 14.

Moreover, the position at which the control element 2 is arranged and the like are similarly not limited to the illustrated example.

More specifically, as described above, the electronic keyboard instrument 5 of the present embodiment includes the plurality of keys 55 which undergo a swinging motion when pressed and released, the control elements 2 which respectively move in accordance with the movement of the keys 55, and the reaction force generator 1, which includes the hollow elastic member 12 made of an elastically deformable material and formed in a hollow dome shape which curves in a convex manner in the initial state as well as the protrusion 14 protruding from the outer surface of the hollow elastic member.

Moreover, letting the axial line L be set to the direction going from the free end of the protrusion 14 towards the hollow elastic member 12, the control element 2 and the reaction force generator 1 are arranged such that when a key 55 moves in response to a keypress operation, the control element 2 presses the protrusion 14 from the second direction X1 different from the first direction parallel to the axial line L and thereby causes the protrusion 14 to tilt towards a first position side. The first region Ar1 which is the portion of the hollow elastic member 12 on the first position side is formed so as to flex (that is, undergo buckling deformation) in a direction opposite to the convex curve present in the initial state once the displacement of the control element 2 reaches a prescribed amount during this keypress operation.

Note that although here an example in which the reaction force generator 1 illustrated in FIGS. 1A and 1B and the like is applied to the electronic keyboard instrument 5 is described, the types of reaction force generators 1 that can be applied to the electronic keyboard instrument 5 are not limited to this example. Reaction force generators of the types in the modification examples described above or reaction force generators 1 having various other types of shapes or configurations can be applied as well.

<Operation and Effects of Electronic Keyboard Instrument Including Reaction Force Generator>

FIGS. 15A to 15D are schematic explanatory drawings for explaining the operation of the reaction force generator 1 and the control element 2 arranged on the hammer 7.

Figure 15A:
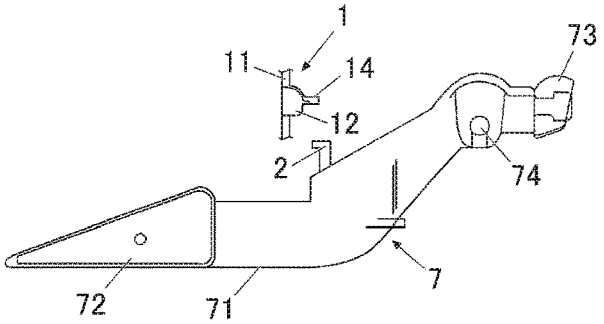
FIGS. 15A to 15D are explanatory drawings schematically illustrating the relationship between a reaction force generator and a control element in the electronic keyboard instrument.

FIG. 15A illustrates a state in an initial position in which the hammer 7 has rotated in a downward direction under the weight of the weight 72 and the weight 72 is resting on the hammer rest 531.

In this state, the control element 2 arranged on the main hammer unit 71 does not contact the protrusion 14 of the reaction force generator 1, and no reaction force is generated.

Figure 15B:
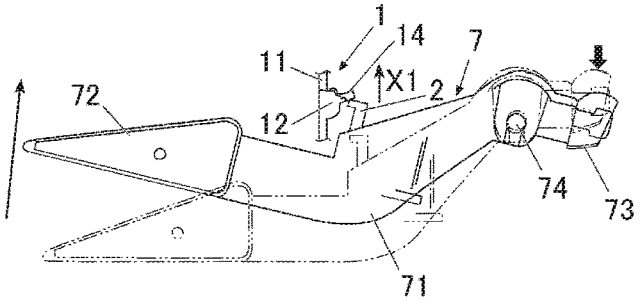

FIG. 15B illustrates how when a key is pressed, the control element 2 swings in a direction which presses the protrusion 14 of the reaction force generator 1 in the second direction X1.

As illustrated in FIG. 15B, once the control element 2 contacts the protrusion 14, the protrusion 14 is pressed and begins tilting towards the first position side, which is the downstream side of the movement direction of the control element 2 (here, the second direction X1).

Then, as the movement (displacement) of the control element 2 in the second direction X1 continues, the protrusion 14 gradually continues tilting towards the first position side (the downstream side of the second direction X1), and the first region Ar1 of the hollow elastic member 12 gradually begins to be depressed and undergo deformation. Once the displacement (press stroke length) of the control element 2 reaches a prescribed amount, the first region Ar1 of the hollow elastic member 12 undergoes buckling deformation.

The first region Ar1 of the hollow elastic member 12 is the thick-walled portion 121 formed to have a relatively large wall thickness, and therefore as illustrated by P5*d* in FIG. 4, the buckling deformation of this first region Ar1 produces a significant reaction force which then decreases dramatically and stabilizes (see FIG. 4). This rapid increase and subsequent rapid decrease in the reaction force creates a clicking feeling, thereby making it possible for the electronic keyboard instrument 5 to produce a feeling similar to let-off (a clicking feeling) for the performer.

Then, the control element 2 clears the protrusion 14 and moves away from the protrusion 14. Once the control element 2 reaches a position no longer contacting the protrusion 14, the reaction force becomes equal to zero, as illustrated by P5*f* in FIG. 4.

Figure 15C:
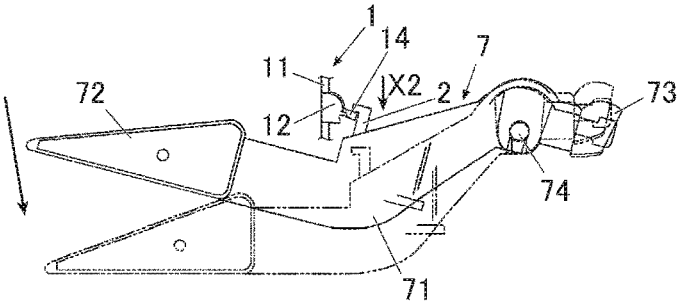

FIG. 15C illustrates the operation which occurs when the keypress operation is ended and the key is released (a key release operation).

As described above, when the key is released, the main hammer unit 71 rotates in a downward direction under the weight of the weight 72. As this occurs, the control element 2 is also displaced (moved) in the third direction X2, and the control element 2 contacts the protrusion 14 from the third direction X2, as illustrated in FIG. 15C.

As the movement (displacement) of the control element 2 in the third direction X2 continues, the protrusion 14 gradually begins tilting towards the second position side (the downstream side of the third direction X2), and the second region Ar2 of the hollow elastic member 12 also gradually begins to be depressed and undergo deformation. Once the displacement (press stroke length) of the control element 2 reaches a prescribed amount, the second region Ar2 of the hollow elastic member 12 undergoes buckling deformation.

The second region Ar2 of the hollow elastic member 12 is the thin-walled portion 122 formed to have a relatively small wall thickness, and therefore this second region Ar2 does not produce much reaction force even upon undergoing buckling deformation (see P6*b* in FIG. 4, for example).

Thus, when the key is released, the control element 2 clears the protrusion 14 and moves away from the protrusion 14 without creating any clicking feeling (let-off).

Figure 15D:
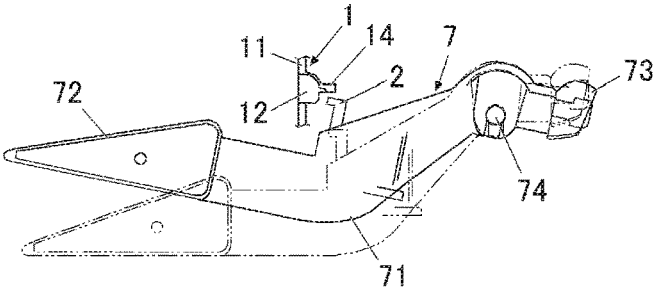

Then, as illustrated in FIG. 15D, once the control element 2 reaches a position no longer contacting the protrusion 14, the reaction force becomes equal to zero, as illustrated by P6*f* in FIG. 4.

As described above, when the reaction force generator 1 is applied to the electronic keyboard instrument 5 as in the present embodiment, once the displacement (press stroke length) of the control element 2 reaches a prescribed amount while on the outgoing path in which the control element 2 moves (is displaced) in the second direction X1, the first region Ar1 of the hollow elastic member 12 undergoes buckling deformation and generates a large reaction force, which then decreases rapidly. This creates a clicking feeling similar to let-off which is transmitted to the fingers of the performer.

Meanwhile, although the second region Ar2 of the hollow elastic member 12 similarly undergoes buckling deformation once the displacement (press stroke length) of the control element 2 reaches a prescribed amount while on the return path in which the control element 2 moves (is displaced) in the third direction X2, even upon buckling, the second region Ar2 constituted by the thin-walled portion 122 does not generate a large reaction force and generates substantially no clicking feeling, thereby allowing the control element 2 to clear the protrusion 14 and return to the initial position smoothly without encountering any significant resistance.

Therefore, when pressing and releasing keys, the performer can experience a performance feeling very similar to that of playing an acoustic piano.

Moreover, because the control element 2 and the hammer 7 on which the control element 2 is arranged can smoothly return to the initial position when a key is released, music can be played smoothly even in performances in which the same keys 55 are repeatedly pressed, for example.

Furthermore, in the present embodiment, the position (arrangement within the electronic keyboard instrument 5) and movement distance of the control element 2 are configured such that when the protrusion 14 is pressed in the second direction X1 in response to a keypress operation, the control element 2 clears the protrusion 14 at a prescribed point in time, and also such that when the protrusion 14 is then pressed in the third direction X2 in response to a subsequent key release operation, the control element 2 again clears the protrusion 14 at a prescribed point in time.

This allows the control element 2 to reliably interact with the protrusion 14 of the reaction force generator 1 when a key is pressed and released, thereby making it possible to produce a feel similar to that of playing an acoustic piano for the performer.

It will be apparent to those skilled in the art that various modifications and variations can be made in the present invention without departing from the spirit or scope of the invention. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

What is claimed is:

1. A reaction force generator, comprising:

a hollow elastic member made of an elastically deformable material and formed to be hollow; and a protrusion protruding from an outer surface of the hollow elastic member and having a free distal end that is tiltable in at least a first direction and a second direction due to elasticity of the hollow elastic member, the first and second directions being not in parallel with and is symmetric with respect to a virtual central line of the protrusion in a neutral position, the virtual central line being a straight line going from the free distal end of the protrusion towards a bottom of the protrusion on the hollow elastic member when the protrusion is not receiving any external force and is in the neutral position, wherein at least one of physical dimensions and material properties of the hollow elastic member is asymmetric with respect to the virtual central line along the first direction and the second direction such that a first reaction force that would be applied to an object by the protrusion when the object engages and tilts the protrusion in the first direction and a second reaction force that would be applied to said object by the protrusion when the object engages and tilts the protrusion in the second direction are asymmetric with respect to the virtual central line.

2. The reaction force generator according to claim 1, wherein the first direction is opposite to the second direction.

3. The reaction force generator according to claim 1, wherein the first direction and the second direction are not perpendicular to the prescribed direction.

4. The reaction force generator according to claim 1, wherein at least one of wall thickness, exterior shape, interior shape, type of material, and density of material of the hollow elastic member is asymmetric with respect to the virtual central line.

5. The reaction force generator according to claim 1, wherein the hollow elastic member is formed such that a relationship between a movement distance of the protrusion and the resulting reaction force is different over an entire stroke length of the protrusion between when the protrusion is tilted in the first direction and when the protrusion is tilted in the second direction.

6. The reaction force generator according to claim 1, wherein the hollow elastic member is formed such that the first reaction force does not monotonically increase and has a peak as a movement distance of the protrusion tilted in the first direction increases.

7. The reaction force generator according to claim 1, wherein the hollow elastic member is formed in a dome shape having a convexity in a neutral state, and wherein the hollow elastic member is formed such that when a movement distance of the protrusion tilted in the first direction reaches a prescribed threshold, a portion of the hollow elastic member on a side towards which the protrusion tilts flexes in a direction opposite to the convexity of the dome shape so as to form a concave portion.

8. The reaction force generator according to claim 6, wherein the hollow elastic member is formed such that the second reaction force monotonically increases as a movement distance of the protrusion in the second direction increases.

9. The reaction force generator according to claim 6, wherein the hollow elastic member is formed such that the second reaction force monotonically increases as a movement distance of the protrusion tilted in the second direction increases, and wherein the hollow elastic member is formed such that the second reaction force is smaller than the first reaction force.

10. The reaction force generator according to claim 1, wherein the free distal end of the protrusion is further tiltable in a third direction that is not in parallel with the virtual central line and is different from the first and second directions, and wherein the at least one of physical dimensions and material properties of the hollow elastic member is asymmetric with respect to the virtual central line along the first, second, and third directions such that the first reaction force, the second reaction force, and a third reaction force that would be applied to said object by the protrusion when the object engages and tilts the protrusion in the third direction are asymmetric with respect to the virtual central line.

11. An electronic keyboard instrument, comprising:

the reaction force generator according to claim 1;

a plurality of key action mechanisms, each of the key action mechanisms including;

a key that undergoes a swinging motion when pressed and released; and a control element that moves in accordance with movement of the key, wherein in each of the plurality of key action mechanisms, the control element is arranged so as to press and tilt the protrusion in the first direction in response to a keypress operation and so as to press the protrusion in the second direction in response to a key release operation.

12. The electronic keyboard instrument according to claim 11, wherein a position and movement distance of the control element are configured such that when pressing the protrusion in the first direction in response to the keypress operation, the control element clears the protrusion at a prescribed position, and also such that when pressing the protrusion in the second direction in response to a subsequent key release operation, the control element clears the protrusion at a prescribed position.

13. An electronic keyboard instrument, comprising a plurality of key action mechanisms, each of the key action mechanisms including:

a key that undergoes a swinging motion when pressed and released;

a control element that moves in accordance with movement of the key; and a reaction force generator including:

a hollow elastic member made of an elastically deformable material and formed in a hollow dome shape having a convexity in a neutral state; and a protrusion protruding from an outer surface of the hollow elastic member, the protrusion being tiltable due to elasticity of the hollow elastic member form a virtual central line that is defined as a straight line going from a free end of the protrusion towards the hollow elastic member when the protrusion is in a neutral position, wherein in each of the key action mechanisms, the control element and the reaction force generator are arranged such that when the key moves in response to a keypress operation, the control element moves in a first direction and engages and presses the protrusion in the first direction that is not in parallel to the virtual central line, thereby causing the protrusion to tilt in the first direction, and wherein in each of the key action mechanisms, the hollow elastic member is formed such that when a displacement of the control element reaches a prescribed amount during the keypress operation, a portion of the hollow elastic member on a side towards which the protrusion tilts flexes in a direction opposite to the convexity of the dome shape so as to form a concave portion.

14. The electronic keyboard instrument according to claim 13, wherein in each of the key action mechanisms, at least one of physical dimensions and material properties of the hollow elastic member is asymmetric with respect to the virtual central line along the first direction and a second direction that is different from the first direction.

15. The electronic keyboard instrument according to claim 13, wherein in each of the key action mechanisms, the control element and the reaction force generator are arranged such that when the key moves in response to a keyrelease operation, the control element moves in a second direction and engages and presses the protrusion in the second direction, thereby causing the protrusion to tilt in the second direction, the second direction being not in parallel to the virtual central line and being different from the first direction, and wherein in each of the key action mechanisms, at least one of physical dimensions and material properties of the hollow elastic member is asymmetric with respect to the virtual central line along the first direction and the second direction so that a relationship between a movement distance of the control element that engages and presses the protrusion and a resulting reaction force applied to the control element by the protrusion is different between when the control element moves in the first direction during the keypress operation and when control element moves in the second direction during the keyrelease operation.

16. The electronic keyboard instrument according to claim 13, wherein in each of the key action mechanisms, the hollow elastic member is formed such that, as a movement distance of the control element in the first direction increases, a resulting reaction force applied to the control element by the protrusion does not monotonically increase and has a peak.

17. The electronic keyboard instrument according to claim 15, wherein in each of the key action mechanisms, the hollow elastic member is formed such that, as a movement distance of the control element the first direction increases during the keypress operation, a resulting reaction force applied to the control element by the protrusion does not monotonically increase and has a peak and such that, as a movement distance of the control element in the second direction increases during the keyrelease operation, a resulting reaction force applied to the control element by the protrusion monotonically increases, and wherein in each of the key action mechanisms, the hollow elastic member is formed such that the reaction force is smaller than the reaction force in at least some of an entire stroke length of the key.

18. The electronic keyboard instrument according to claim 15, wherein in each of the key action mechanisms, the free distal end of the protrusion is further tiltable in a third direction that is not in parallel with the virtual central line and is different from the first and second directions, and wherein in each of the key action mechanisms, the at least one of physical dimensions and material properties of the hollow elastic member is asymmetric with respect to the virtual central line along the first, second and third directions such that a relationship between a movement distance of the protrusion and a resulting reaction force generated by the protrusion is different among the first, second, and third directions of movement of the protrusion.

19. The electronic keyboard instrument according to claim 15, wherein in each of the key action mechanisms, a position and movement distance of the control element are configured such that when pressing the protrusion in the first direction in response to the keypress operation, the control element clears the protrusion at a prescribed position, and also such that when pressing the protrusion in the second direction in response to a subsequent key release operation, the control element clears the protrusion at a prescribed position.

20. The electronic keyboard instrument according to claim 15, wherein in each of the key action mechanisms, the first direction is opposite to the second direction.

* * * * *